US008879766B1

(12) United States Patent
Zhang

(10) Patent No.: US 8,879,766 B1
(45) Date of Patent: Nov. 4, 2014

(54) FLAT PANEL DISPLAYING AND SOUNDING SYSTEM INTEGRATING FLAT PANEL DISPLAY WITH FLAT PANEL SOUNDING UNIT ARRAY

(76) Inventor: Wei Zhang, Newtown, PA (US)

( * ) Notice: Subject to any disclaimer, the term of this patent is extended or adjusted under 35 U.S.C. 154(b) by 414 days.

(21) Appl. No.: 13/269,546

(22) Filed: Oct. 7, 2011

Related U.S. Application Data

(60) Provisional application No. 61/542,378, filed on Oct. 3, 2011.

(51) Int. Cl.
*H04R 1/02* (2006.01)

(52) U.S. Cl.
USPC ..... 381/333; 381/388; 381/396; 381/401; 381/406

(58) Field of Classification Search
CPC ..... H04R 1/02; H04R 5/02
USPC ..... 381/306, 333, 388, 406, 396, 401
See application file for complete search history.

(56) References Cited

U.S. PATENT DOCUMENTS

| | | | | |
|---|---|---|---|---|
| 6,427,017 | B1 * | 7/2002 | Toki | 381/190 |
| 7,548,766 | B2 * | 6/2009 | Takahata et al. | 455/569.1 |
| 8,199,960 | B2 * | 6/2012 | Eaton | 381/388 |
| 2011/0248935 | A1 * | 10/2011 | Mellow et al. | 345/173 |

* cited by examiner

*Primary Examiner* — Disler Paul

(57) ABSTRACT

In accordance with the invention, the disclosure presents a flat panel displaying and sounding system integrating a flat panel display with a flat panel sounding unit array. Generally, the flat panel displaying and sounding system comprises a panel surface for both displaying picture and emanating audible sound, a flat panel display means for said displaying picture and a flat panel sounding unit array means for said emanating audible sound. The flat panel system may be made by attaching a flat panel displaying layer with a flat panel sounding unit array. Furthermore, the flat panel system may be made by disposing a flat panel displaying layer inside layers of a flat panel sounding unit array. Furthermore, layer level integration may be used to implement function needed for displaying and function necessary for sounding on one integrated layer.

9 Claims, 35 Drawing Sheets

| Channel # | Soundtrack ID | Channel Type | Screen Correlated Region |
|---|---|---|---|
| 0 | xxxx | 0: fixed | Virtual screen definition; X-Ys of polygon points |
| 1 | xxxx | 0: fixed | Virtual screen definition; X-Ys of polygon points |
| 2 | xxxx | 0: fixed | Virtual Screen definition; X-Ys of polygon points |
| ⋮ | ⋮ | ⋮ | ⋮ |
| m | xxxx | 1: dynamic | Virtual Screen definition; X-Ys of polygon points |

FIGURE 35

FLAT PANEL DISPLAYING AND SOUNDING SYSTEM INTEGRATING FLAT PANEL DISPLAY WITH FLAT PANEL SOUNDING UNIT ARRAY

CROSS-REFERENCE TO RELATED APPLICATIONS

The present application claims the benefit of U.S. Provisional Application Ser. No. 61/542,378 filed by Wei Zhang on Oct. 3, 2011 and titled "Flat Panel Displaying and Sounding System Integrating Flat Panel Display With Flat Panel Sounding Unit Array", which is incorporated herein by reference.

STATEMENT REGARDING FEDERALLY SPONSORED RESEARCH OR DEVELOPMENT

Not applicable.

FIELD OF THE INVENTION

The present invention relates to a flat panel display with audio playing capability.

BACKGROUND OF THE INVENTION

Flat panel display system is typically built and improved to present better picture quality of video media. The flat panel display system may have one or several speakers embodied into peripheral frame of the flat panel display system to play accompanying audio media. Because it is commonly disadvantageous to enlarge thickness of system enclosure or frame periphery region surrounding displaying region, above arrangement of speakers limits the size of each speaker and number of speakers that could be feasibly accommodated. Thus, sound quality rendered by the onboard speakers is much inferior to an independent sound system, and, typically limited to lower level of stereo sound. In general, the onboard speakers of flat panel display system seems to be more like a conveniently add-on feature upon presumption of not having substantial detrimental effect on the primitive displaying features rendered by flat panel display. For the same reason, many flat panel display system does not provide audio playing feature at all, leaving audio media to be played by an independent audio system that can deliver high quality surrounding sounds and enriched sounding features for much better viewer experience.

Referring to FIG. 1, a typical viewer context to view a movie played on a flat panel display is illustrated. The flat panel display 10, for example a flat panel television, shows the pictures of the movie in displaying surface region 11 surrounded by frame region 12. The onboard speakers 13 are incorporated inside the frame region. Due to inferior sound quality of the onboard speakers, an independent sounding system, for example a home theater system, is installed in the room to play audio media of the movie. The sounding system has a central electronic unit 17 to process input audio media and drive system speakers. The system speakers include a front center speaker 14, front left and right speakers 15, rear surrounding speakers 16, and a subwoofer 18 for low frequency sounds. More advanced home theater systems may have more speakers to render more channels of surrounding sounds.

Flat panel display is made generally irrelevant to speaker technology. The presence of speakers inside enclosure of a flat panel display only involves system level installation of discrete and separate speaker components. As flat panel display technology advances remarkably, audio media sounding technology advances according to its own technological path not much correlating with display technology and seemingly retaining such trend in foreseeable future. Under view of such trend, a future flat panel display seems either not having audio sounding feature or having speaker components installed at system level just like how speaker feature is currently implemented.

The information disclosed in this Background of the Invention section is only for the enhancement of understanding of the background of the invention, and should not be taken as an acknowledgment or any form of suggestion that this information forms a prior art that would already be known to a person skilled in the art.

BRIEF SUMMARY OF THE INVENTION

It is believed and aimed by applicant that correlating flat panel display technology with audio media sounding technology in very intimate manner in term of technological relation may push integration of displaying and sounding into an unprecedented level of integration and render superior viewing and hearing experiences to users. The invention disclosed in this application is in effort to pursue this aim.

In accordance with the invention, the disclosure presents a flat panel displaying and sounding system integrating a flat panel display with a flat panel sounding unit array. Image displaying surface of the flat panel displaying and sounding system is not only where pictures are shown, but also where sounding waves come out. Generally, the flat panel displaying and sounding system comprises a panel surface for both displaying picture and emanating audible sound, a flat panel display means for said displaying picture and a flat panel sounding unit array means for said emanating audible sound. The flat panel system may be made by attaching a flat panel displaying layer with a flat panel sounding unit array. Furthermore, the flat panel system may be made by disposing a flat panel displaying layer inside layers of a flat panel sounding unit array. Furthermore, layer level integration may be used to implement function needed for displaying and function necessary for sounding on one integrated layer. It is to be understood that obvious dividing line may not be indispensably present in the flat panel displaying and sounding system to discern which layer belongs to the displaying layer or the sounding unit array.

In accordance with the invention, a general embodiment of the flat panel displaying and sounding system comprises a flat panel displaying layer having a viewing surface and a flat panel sounding unit array having a sound emanating surface. The flat panel sounding unit array has a plurality of sounding units distributed in array form. During operation, lights of pictures come from the viewing surface and sound waves come out of the sound emanating surface. The flat panel sounding unit array is proximately attached to the flat panel displaying layer in such manner that both the sound emanating surface and the viewing surface face toward viewing side of the flat panel system.

In accordance with the invention, another general embodiment of the flat panel displaying and sounding system comprises a flat panel displaying layer having a viewing surface and a flat panel sounding unit array having a sound driver array panel and a sound generating layer. The sound driver array panel has an array of a plurality of sound drivers distributed in array form on a substrate. During operation, lights of pictures come from the viewing surface, and, the sound generating layer is driven by the sound drivers to generate sound waves. The flat panel displaying layer is sandwiched by the sounding generating layer and the sound driver array in such manner that the viewing surface is adjacent the sound generating layer, thus both facing toward viewing side of the flat panel system. In the general embodiment, the sound generating layer is transparent to visible light outputted from the view surface so that picture shown on the displaying layer could be seeable.

In accordance with the invention, another general embodiment of the flat panel displaying and sounding system comprises a flat panel displaying layer having a viewing surface and a flat panel sounding unit array having a sound emanating surface, wherein, during operation, lights of pictures come from the viewing surface and sound waves come out of the sound emanating surface. The flat panel displaying layer is proximately attached to the flat panel sounding unit array in such manner that both the viewing surface and the sound emanating surface face toward viewing side of the flat panel system. In the general embodiment, the flat panel sounding unit array is transparent to visible light outputted from the view surface, thus rendering picture shown on the displaying layer seeable.

Accordingly, in consistent with above general embodiments, the flat panel displaying layer comprises at least image pixel switching layer of the flat panel display type, such as, liquid crystal layer and control electrode layers for Liquid Crystal Display or LCD type, LED pixel matrix layer for Light Emitting Diode or LED display type, OLED pixel matrix layer for Organic Light Emitting Diode or OLED display type, plasma cell matrix layer and control electrode layers for Plasma Display Panel or PDP display type, microcapsule contained liquid polymer layer and control electrode layers for Electrophoretic display or the like type, or, the like for other type of flat panel display. The other layers of the display type supplemental to the image pixel switching layer for purpose to fulfill displaying may be included in the flat panel displaying layer or added into the system assembly, or, have their specific functions integrated into layers of the system assembly.

Furthermore, in accordance with the invention, the disclosure gives some more specific embodiments of flat panel displaying and sounding system.

Furthermore, In accordance with the invention, the disclosure contains embodiments of subsystems or elements useful for the flat panel system.

Furthermore, in accordance with the invention, the disclosure provides some schemes to drive flat panel sounding unit array, which is useful for flat panel displaying and sounding system.

Furthermore, in accordance with the invention, the disclosure contains the methods to use the flat panel displaying and sounding system for a variety of sounding effects. One method is to create surrounding sound effects by forming directional sound beams that are reflected toward viewer. Another method is to deliver multi language soundtracks to specific viewers without interfering each other by forming directional sound beams without substantial beam overlapping at viewer locations. Another method is to form a directional sound beam toward viewer to reduce sound level hearable by other persons nearby, thus no longer having to use a headphone. Another method is to divide displaying surface of the system into multi regions, each region having a corresponding soundtrack to play, thus creating a displaying objective correlated sounding effect. Another method is to dynamically present a soundtrack for a moving objective of displaying picture, thus having moving object correlated sounding effect. Audio media encoding scheme to encode the moving objective soundtrack in audio data is discussed for enlightening how to implement. To facilitate understanding potentials of the flat panel displaying and sounding system, several application scenarios are exemplarily discussed to show how to use flat panel displaying and sounding system.

In accordance with the invention, above description of summary is best effort to fulfill purpose or need of Brief Summary of Invention section and should not be used for purpose to reduce or be against merits of the invention as a whole. Furthermore, not to be limited by this section, all patentable rights embodied in or derived from the complete disclosure are reserved without prejudice.

BRIEF DESCRIPTION OF THE SEVERAL VIEWS OF THE DRAWINGS

It should be understood that the brief description of the several views of the drawings is only for the purpose of presenting a concise reference to accompanying drawings and should not be inferred to have any suggestion to limit or reduce the scope of invention. Furthermore, the concepts and embodiments of the invention explicitly or implicitly shown in the drawings are only possibly understood accordingly by referring to following detailed descriptions upon illustrative showings of the drawings. For illustrative purpose, the drawings are not in scale. In the drawings:

FIG. 11 illustratively shows sound transmission passages and sound impedance matching layers presented in a liquid crystal display to facilitate sound wave passing through.

FIG. 14 is illustrative design showings of grating or mesh patterns permitting visible light to pass through.

FIGS. 15A and 15B are illustrative pattern design showings of electromagnetic coil for passing visible light through.

FIG. 35 exemplarily shows an audio media content containing picture area correlated soundtrack and moving object correlated soundtracks, which are encoded using the dynamic encoding scheme illustratively shown in FIGS. 34A and 34B.

DETAILED DESCRIPTION

In accordance with the invention, the disclosure presents a flat panel displaying and sounding system integrating a flat panel display with a flat panel sounding unit array. Image displaying surface of the flat panel displaying and sounding system is not only where pictures are shown, but also where sounding waves come out. Generally, the flat panel displaying and sounding system comprises a panel surface for both displaying picture and emanating audible sound, a flat panel display means for said displaying picture and a flat panel sounding unit array means for said emanating audible sound. The flat panel system may be made by attaching a flat panel displaying layer with a flat panel sounding unit array. Furthermore, the flat panel system may be made by disposing a flat panel displaying layer inside layers of a flat panel sounding unit array. Furthermore, layer level integration may be used to implement function needed for displaying and function necessary for sounding on one integrated layer. It is to be understood that obvious dividing line may not be indispensably present in the flat panel displaying and sounding system to discern which layer belongs to the displaying layer or the sounding unit array.

In accordance with the invention, the following some general embodiments of flat panel displaying and sounding system are described to manifest conceptual principles of the system. All specific embodiments developed upon the conceptual principles, no matter whether resembling to apparent appearances of the drawings associated with the general embodiments, are considered to fall into the merits or teaching spirits explicitly or implicitly expressed in the general embodiments, and within the scope of this disclosure in accordance with the invention.

Figure 1:
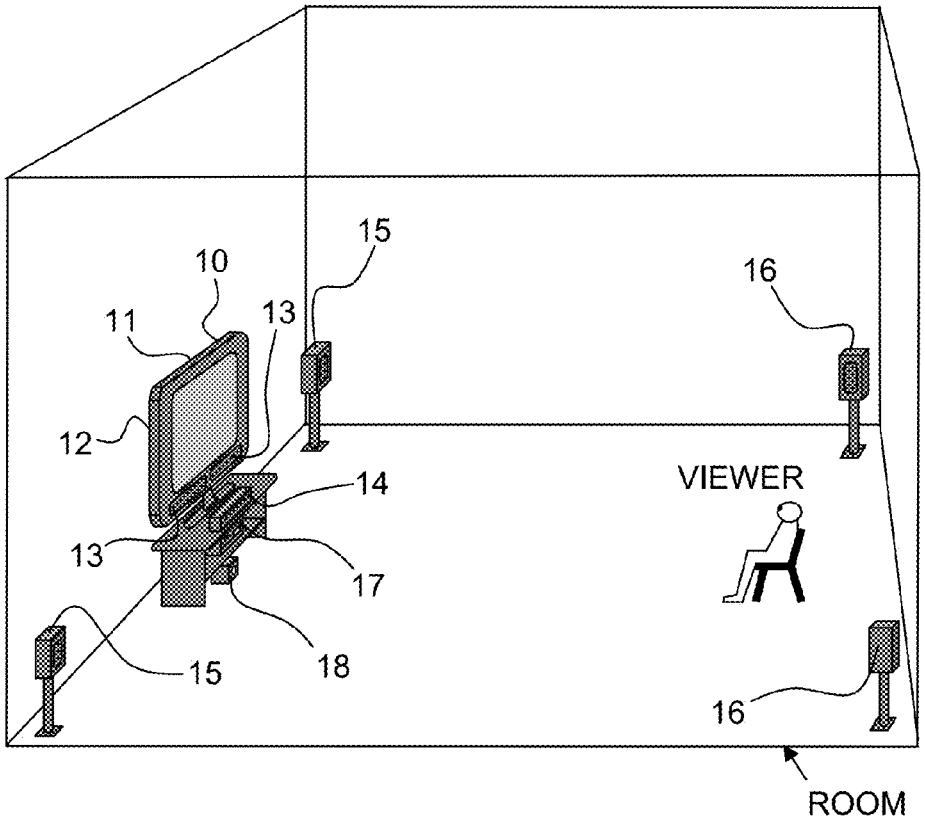
FIG. 1 illustrates a typical scenario of viewing video of a movie on flat panel display while playing audio of the movie on an independent sound system, such as home theater system, due to inferior sound quality of onboard speakers, if presence, of the flat panel display.
Figure 2:
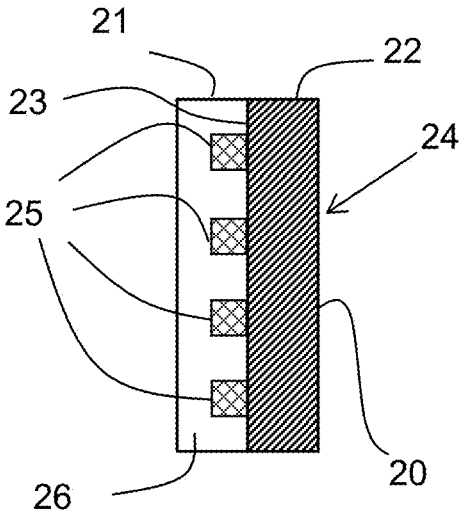
FIGS. 2, 3, and 4 are illustrative showings of general embodiments of flat panel displaying and sounding system in accordance with the invention.

In accordance with the invention, referring to FIG. 2, a general embodiment of flat panel displaying and sounding system is formed by attaching a flat panel sounding unit array 21 to rear surface of a flat panel displaying layer 22. The flat panel displaying layer has a front viewing surface 20, which, in displaying, emanates lights of picture shown by the displaying layer. Flat panel sounding unit array 21 has a plurality of sounding units 25 carried by body panel 26 and distributed at any array format. Sounding surfaces of all the sounding units collectively form a sound emanating surface 23 for the flat panel sounding unit array. The sounding units under driven by electrical signals emanate sound waves predominately outward away the sound emanating surface, which is toward front side 24 of the system. The front side is the viewing side of the system for a viewer to see pictures, and, also the side for sound waves to come out. The attachment is to effectively assemble the flat panel displaying layer and the flat panel sounding unit array together to form a flat panel system and work as a flat panel system. Thus, the attachment may be either in contact or in proximity. For proximity attachment, the system may have a frame (not shown) to hold the flat panel displaying layer and the flat panel sounding unit array in proximity positions. For both contact and proximity attachments, intermediate layer or layers may be present in-between to improve attachment quality or sound transmission, or both. For example, an adhering layer may be used to bond the two panels together. For another example, a multi polymer layers of varying densities may be used in-between to match sound impedance difference of the two panels for better sound transmission. For another example, an intermediate layer with cut-through regions may be inserted in between and bonded both sides, but having the cut-off regions corresponded to the sounding units. In such example, the two panels are attached in contact from overall configuration, but, regions of sounding units are like to attach in proximity with a gap determined by the intermediate layer thickness.

Figure 3:
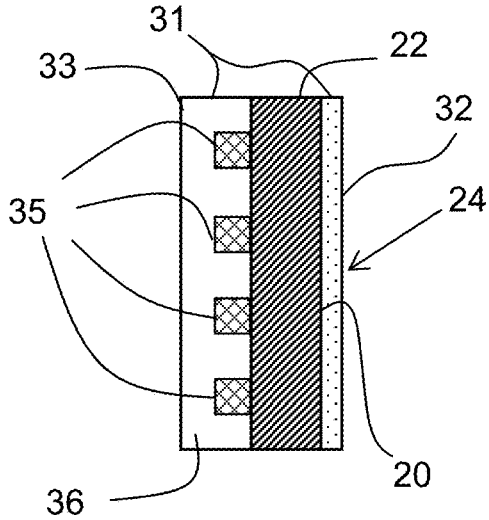

In accordance with the invention, referring to FIG. 3, a general embodiment of flat panel displaying and sounding system is formed by sandwiching a flat panel displaying layer 22 between sound driver array panel 33 and sound generating layer 32, which collectively and effectively form a flat panel sounding unit array 31. The flat panel displaying layer has a front viewing surface 20, which, in displaying, emanates lights of pictures. Viewing surface 20 is adjacent to sound generating layer 32, which in turn representing front side 24 of the system. Sound driver array panel 33 has a plurality of sounding drivers 25 carried by body panel 36 and distributed at any array format. Sound generating layer 32 under remotely driven by sounding drivers 25 generates sound waves predominately propagating toward front side 24. The front side is the viewing side of the system for a viewer to see pictures, and, also the side for sound waves to come out. Therefore, sounding generating layer 32 must be transparent for visible lights of displaying layer 22 to pass through, without severely detrimental to displayed image quality. The sound driver may drive the sound generating layer remotely by generating a varying magnetic filed, The sound generating layer containing magnetic sensitive material vibrates to generate sound waves in response to the varying magnetic field. The thinner the flat panel displaying layer is, the stronger and more sensitive magnetic responsiveness is expected. The frequency of the varying magnetic field is in range of audible sound. It is much lower than frequency of driving signals of the flat panel displaying layer. Therefore, the varying magnetic field does not interfere working of the flat panel displaying layer at all or at very minimal level. If necessary, a low frequency filter circuitry may be added into driving circuit of the flat panel displaying layer to filter out possible interference induced by the varying magnetic field. To have certain transparency to visible light, the sound generating layer may be made of a transparent flexible film containing magnetic particles, thin layer of ferromagnetic materials, patterned layer of ferromagnetic material, or electromagnetic coil layer of metal or conductive material, or any way the like, to get magnetic responsiveness.

Figure 4:
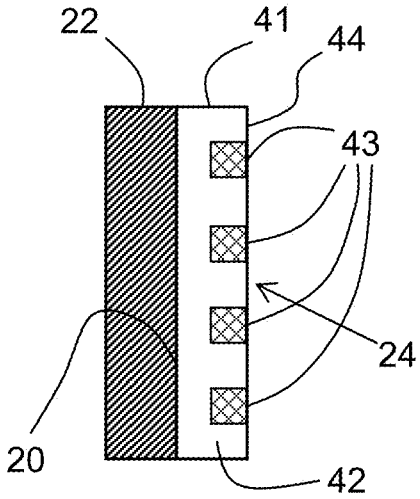

In accordance with the invention, referring to FIG. 4, a general embodiment of flat panel displaying and sounding system is formed by attaching a flat panel sounding unit array 41 in front of viewing surface 20 of a flat panel displaying layer 22. The viewing surface faces toward front side 24 of the system. Flat panel sounding unit array 41 has a plurality of sounding units 43 carried by a body panel 42 and distributed at any array format. Sounding surfaces of all the sounding units collectively and effectively form a sound emanating surface 44 for the flat panel sounding unit array. The sounding units under driven by electrical signals emanate sound waves predominately outward away the sound generating surface, which is on front side 24 of the system. The front side is the viewing side of the system for a viewer to see pictures, and, also the side for sound waves to come out. The attachment is to effectively assemble the flat panel displaying layer and the flat panel sounding unit array together to form a flat panel system and work as a flat panel system. Thus, the attachment may be either in contact or in proximity. For proximity attachment, the system may have a frame (not shown) to hold the flat panel displaying layer and the flat panel sounding unit array in proximity positions. For both contact and proximity attachments, intermediate layer or layers may be present in between to improve attachment quality or light transmission, or both. For example, an adhering layer may be used to bond the two panels together. For another example, a plurality of dielectric layers of various diffractive indexes may be used in between as anti-reflection coating to promote visible light transmission. For displaying image seeable, fat panel sounding unit array 41 must be transparent to visible light. To get certain transparency, body panel must be a substrate made of transparent materials, such as glass, quartz, sapphire, optical grade PMMA, or, other transparent polymer. The sounding units should be visibly transparent too. To achieve that, one practical way is to miniaturize the sounding unit to become invisible to human eyes. Then, by delicately designing its structures to have as many light passing channels as possible or have as much unoccupied light passing areas as possible, the sounding unit could allow certain percentage of lights passing through. State-of-art MEMS or NEMS (abbreviations of Micro or Nano Electrical Mechanical System) techniques and technology of subwavelength optical grating or mesh wires can be jointly used to enable that. To be more specific, MEMS or NEMS techniques contribute to miniaturization of sounding unit structure design and its optimization for light transmission. Subwavelength optical grating or mesh wires are further implemented into detailed pattern structures of components of the miniaturized sounding units to improve transparency. Therefore, a reasonable or acceptable transparency of the sounding unit is expected to be achievable. This approach also allows the whole array of the sounding units to be made simultaneously on a substrate for body panel 42 by using semiconductor thin film processing techniques, like a manufacturing process to make integrated circuit. Another practical way to make sounding unit visibly transparent is to use transparent electric conduction materials and dielectrics to make thin film sounding units by micro/nanofabrication using state-of-art semiconductor processing on the substrate of body panel 42. Transparent electric conduction materials include ITO (Indium tin oxide), AZO (Aluminum zinc oxide), GZO (Gallium zinc oxide), IZO (Indium zinc oxide), conducting polymers, carbon nanotube, graphene, or the like. Thin layer of doped polysilicon or porous silicon can be used as transparent electric conduction layer as well, although it is not classified as a visible transparent material. Dielectrics are typically visibly transparent, for example, SiO2, Nitride, HfO2, Ta2O5, and the like. Metal wires can be used for electrical connection purpose providing the wires are narrowed enough and spaced sufficiently to pass lights. Furthermore, Subwavelength optical grating or mesh patterns can be implemented in the structures of the sound units and their related control circuitry to improve light transmission. This approach based on using transparent conductor and dielectrics for primitive components of sounding units is capable of making sounding units as large as necessary for desired acoustic performance. The approach also permits to simultaneously make the array of sounding units on the substrate of body panel 42, similar to manufacturing process of integrated circuit. Alternatively, both approaches may have array of sounding units fabricated on a substrate, then, transferred onto the substrate of body panel 42. This transfer method is especially useful when the body panel is a flexible substrate, such as polymer film, very thin glass or quartz substrate, or the like.

Accordingly, in consistent with above general embodiments, the flat panel displaying layer comprises at least image pixel switching layer of the flat panel display type, such as, liquid crystal layer and control electrode layers for Liquid Crystal Display or LCD type, LED pixel matrix layer for Light Emitting Diode or LED display type, OLED pixel matrix layer for Organic Light Emitting Diode or OLED display type, plasma cell matrix layer and control electrode layers for Plasma Display Panel or PDP display type, microcapsule contained liquid polymer layer and control electrode layers for Electrophoretic display or the like type, or, the like for other type of flat panel display. The other layers of the display type supplemental to the image pixel switching layer for purpose to fulfill displaying may be included in the flat panel displaying layer or added into the system assembly, or, have their specific functions integrated into layers of the system assembly. For example, in additional to image pixel switching layer, which is liquid crystal polarization steering layer here, LCD display needs an illumination layer or backlight layer, first polarizer layer, color filter layer, and, second polarizer layer to fulfill displaying function. These layers should be added into proper positions of system assembly in additional to the liquid crystal polarization steering layer accordingly.

In accordance with the invention, the flat panel sounding unit array is to be discussed about its embodiments and making. The embodiments of the flat panel sounding unit array are implemental to above general embodiments of the flat panel displaying and sounding system. More than that, the embodiments of the flat panel sounding unit array are implemental to stand-alone sounding systems as well. It should be understood that following embodiments of the flat panel sounding unit array may be implemented as a whole, or have their functional layers or elements implemented separately into system assembly of the flat panel displaying and sounding system, but functioning as a whole no matter which way to implement. It is believed that an ordinary skill artisan is able to carry on the implementations according to directive teachings of this disclosure.

Flat panel sounding unit array disclosed in this disclosure is generally classified into two category: monolithic array and integrated array. They are discussed respectively in followings.

Monolithic array type has sounding units produced monolithically, then, assembled in array form on a carrier substrate. The carrier substrate holds each monolithic sounding unit on its surface or has it embedded into substrate body. The carrier substrate may contain control circuit to drive the sounding unit. The control circuit is made, prior to assembling the sounding units on the substrate, by using Printed Circuit Board (PCB) process or Integrated Circuit (IC) process. Assembling process may be accomplished by using PCB assembling techniques, high speed mounting tape techniques or other component assembling techniques. The monolithic sounding unit may be made by any feasible process to make a sounding devices, including speaker manufacturing process, MEMS or NEMS process, semiconductor processing, and so on. Thus, the sounding units may have a variety of sizes and characteristics resulted from the technology relied upon to make. It is possible that vastly different sounding units made by different technologies are assembled together to form an array for the purpose. Therefore, best characteristics provided by different technologies may be present in the same array to improve sounding performance of the system. It is obvious to see that carrier substrate is here corresponding to body panel 26, 36, or 42 previously described.

Integrated array type has all sounding units produced simultaneously and array of the same formed naturally on a substrate using semiconductor processing similar to IC processing. The control circuit of the sounding units can be made together with the sounding units by using the semiconductor processing as well. This type potentially has much lower average cost for each sounding unit and may have a large number of sounding units included in the array. This type also benefits from state-of-art microfabrication and nanofabrication techniques and future advancement thereof. This type can be very thin due to thin film nature of semiconductor processing. Furthermore, the completed array as well as control circuit may be further transferred upon another substrate by bonding and transferring process. It is especially useful to make a flexible flat panel sounding unit array by transferring completed array initially fabricated on a semiconductor processing friendly substrate onto a flexible substrate or film.

Figure 5A:
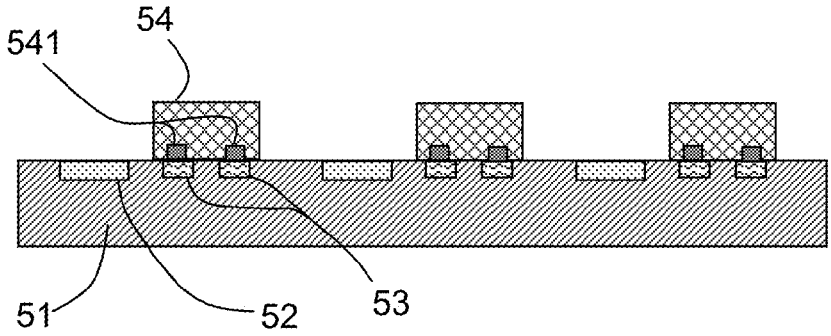
FIGS. 5A, 5B, and 5C illustratively show a variety of embodiments of flat panel sounding unit array based on assembly of discrete sounding units, which are useful for flat panel displaying and sounding system in accordance with the inventions.
Figure 5B:
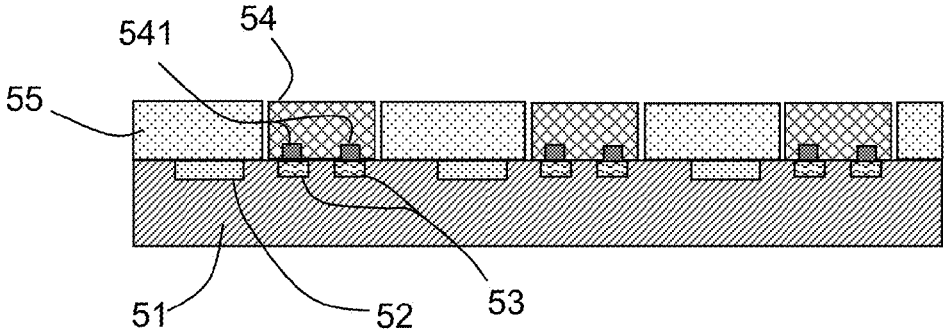
Figure 5C:
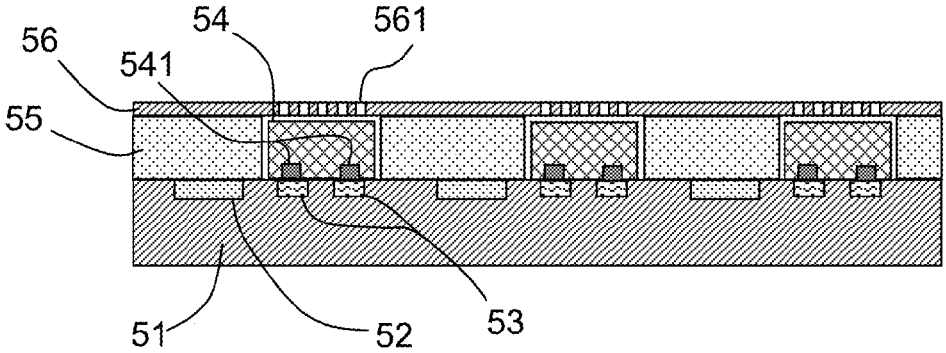

Referring to FIG. 5A, an embodiment of flat panel sounding unit array of monolithic array type comprises a circuit substrate 51 and sounding units 54 mounted on the substrate. The substrate may further contain control circuits 52 having contacts 53 to drive corresponding sounding units. Contacts 53 electrically connect to electric input 541 of corresponding sounding unit 54. Referring to FIG. 5B, an embodiment of flat panel sounding unit array has the same features as the embodiment referring to FIG. 5A, and, in addition, a spacer layer 55 to approximately level with top surface of sounding units 54. The approximately leveled top surface across the substrate improves attachment of the flat panel sounding unit array to other surfaces in system implementation. Referring to FIG. 5C, an embodiment of flat panel sounding unit array has the same features as the embodiment referring to FIG. 5B, and, in addition, a cover layer 56 on top of spacer layer 55 to encapsulate sounding units 54 in their corresponding cells. The cover layer has sound transmission channels 561 at areas corresponding to cells of sounding units 54 to facilitate sound transmission. The sound transmission channels may be either hollow or filled with sound transmission media, for example porous materials, low density polymers. In consistent with the illustratively showing, the sounding unit is assumed to have its sounding surface facing the cover layer and connected to outside through the sound transmission channels.

Figure 6A:
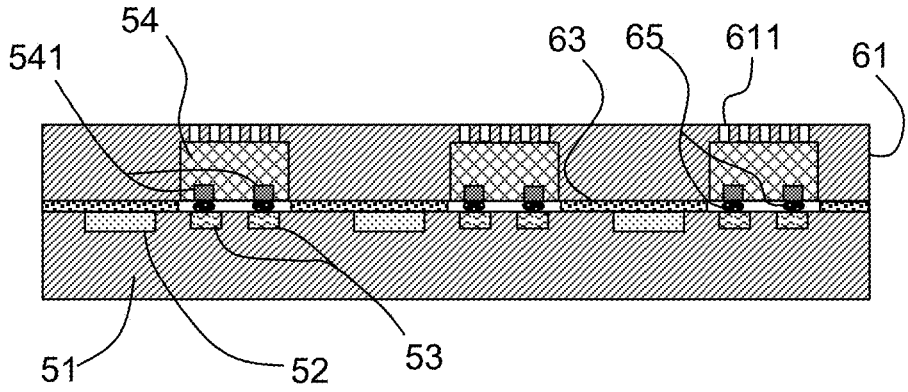
FIG. 6A illustratively shows a preferred embodiment of flat panel sounding array based on assembly of discrete sounding units, which are useful for flat panel displaying and sounding system in accordance with the inventions.
Figure 6B:
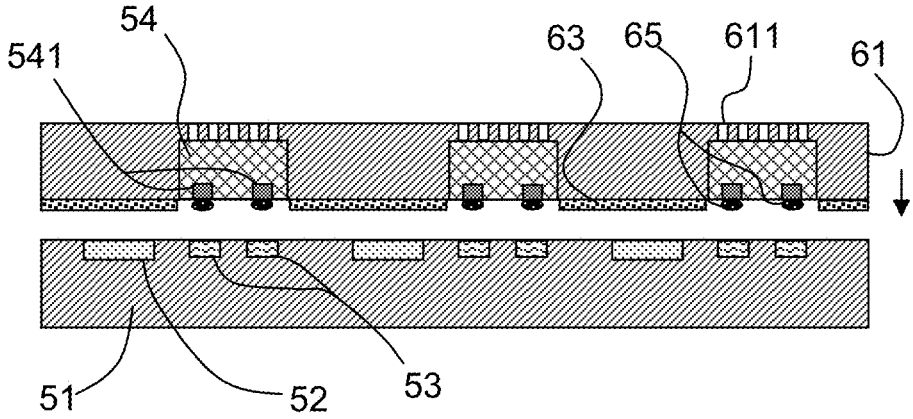
FIGS. 6B and 6C illustratively show approaches to make the preferred embodiment.
Figure 6C:
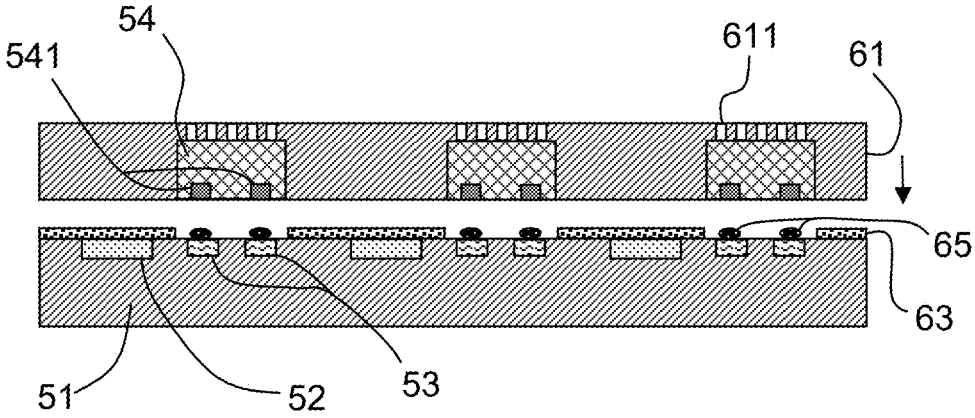

Referring to FIG. 6A, an embodiment of flat panel sounding unit array of monolithic array type comprises a carrier substrate 61 and a circuit substrate 51, the two substrates attached together by an adhering layer 63. Sounding units 54 having electric inputs 541 are embedded into the carrier substrate with electric inputs 541 approximately leveling to the attaching surface of the carrier substrate. The opposite surface of the carrier substrate contains the exit-end of sound transmission channels 611, which has the entry-end connected to sounding surfaces of the sounding units. The transmission channels may be either hollow or filled with sound transmission media to facilitate sound waves coming out. The circuit substrate contains control circuit 52 having contacts 53 to drive the sounding units, made on the substrate by using printing circuit techniques or semiconductor fabrication techniques. Contacts 53 are bonded both mechanically and electrically with electric inputs 541 through conduction adhering materials 65. Flip chip bonding process can be used to fulfill the bonding need, in which conduction adhering materials 65 are typically solder bumps or pads. The bonding process can be performed in a variety of ways. One way, as illustrated in FIG. 6B, is to apply adhering layer 63 and conduction adhering materials 65 on the attaching surface of carrier substrate 61, then, complete attachment to form adhesion between the two substrates and electric connections between contacts 53 and inputs 541. Another way, as illustrated in FIG. 6C, is to apply adhering layer 63 and conduction adhering materials 65 on the attaching surface of circuit substrate 51, then, complete attachment to form adhesion between the two substrates and electric connections between contacts 53 and inputs 541. Another way (not shown) is to apply adhering layer 63 on the attaching surface of one substrate and conduction adhering materials 65 on the attaching surface of the other, then, complete attachment of the two substrates.

Figure 7A:
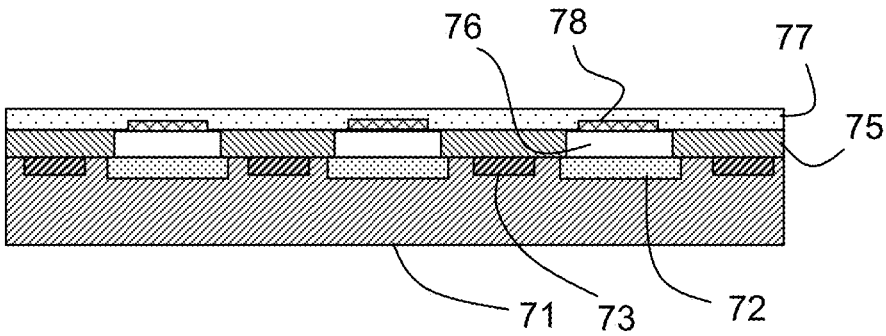
FIGS. 7A, 7B, and 7C illustratively show a variety of embodiments of flat panel sounding unit array based on semiconductor thin film fabrications, which are useful for flat panel displaying and sounding system in accordance with the inventions.

Referring to FIG. 7A, an embodiment of flat panel sounding unit array of integrated array type comprises a substrate 71, an electronic device layer of sound drivers 72 and control circuits 73 to drive the sound drives on the substrate, and, a sound generating layer 77 laid on top of the electronic device layer with a spacer layer 75 in between. The spacer layer separates the electronic device layer and the sound generating layer at a predetermined distance. The spacer layer has recessed surface regions adjacent layer 77 and laterally aiming to the sounding drivers to form cavities 76 underneath layer 77. (The drawing illustrates an extreme case of the recess surface regions as hollow through the layer.) Cavities 76 permit above portion of the sound generating layer to vibrate under driven by the sound drivers, thus generating sound waves. The sound generating layer, the spacer layer and the electronic device layer can be fabricated in the same semiconductor processing. Or, the sound generating layer is made separately and bonded onto the spacer layer already made together with the electronic device layer by semiconductor processing. As illustrated in FIG. 7A, sound generating layer 77 embodies driver response media 78 at least substantially covering cavity areas. The driver response media interacts remotely with the sound driver to cause layer 77 vibrating. If the sound driver creates varying magnetic field to agitate the sound generating layer, the driver response media may be ferromagnetic particles such as Ni, Co, ferromagnetic alloy, or the like, which is disperse in body materials of the layer. Or, it may be ferromagnetic materials such as Ni, Co, ferromagnetic alloy, or the like, which is shadow deposited on by sputtering or e-beam evaporation across whole area or selectively on cavity areas. If the sound driver uses electrical field to agitate the sound generating layer, the driver response media may be charged ions or electrode made of conductive material such as metal, transparent conductive material or conductive polymer, which, in together with electrode of corresponding driver, forms a capacitor like structure. If ultrasonic sound is emitted by the piezoelectric type sound driver to agitate the sound generating layer, the driver response media is a ultrasound stopping material, such as high density dielectrics, ceramics or metals, which reflects or absorbs ultrasound energy to vibrate. The sound generating layer may have its corresponding cavity region patterned like suspended diaphragm of in order to achieve desired sounding performance, similar to diaphragm mechanism of speakers.

Figure 7B:
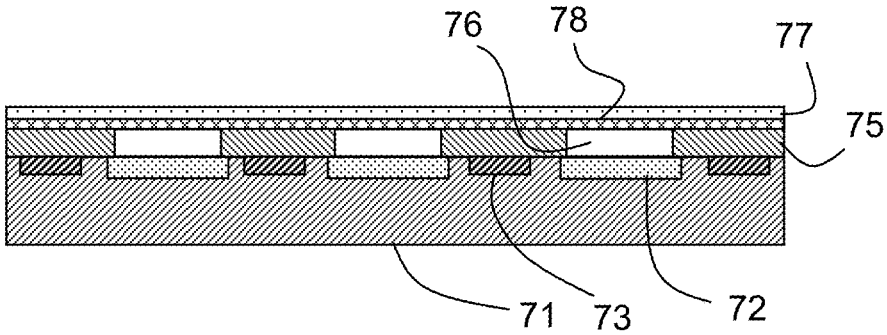

In another embodiment of flat panel sounding unit array of integrated array type, as illustrated in FIG. 7B, sound generating layer 77 comprises a layer of driver response media 78 uniformly across its surface. The embodiment has other features the same as the embodiment referring to FIG. 7A.

Figure 7C:
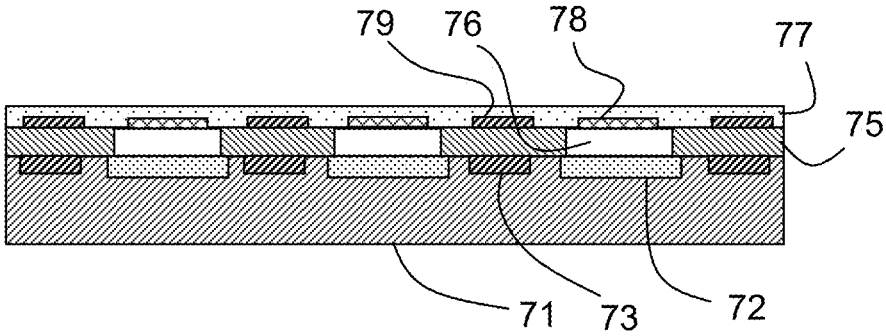

In another embodiment of flat panel sounding unit array of integrated array type, as illustrated in FIG. 7C, sound generating layer 77 comprises driver response media 78 substantially covering cavity areas and electric circuit 79 connected to the media. As illustratively shown in the drawing, the embodiment may have other features the same as the embodiment referring to FIG. 7A. Alternatively, not as illustratively shown, the embodiment may have a magnetic field layer made of ferromagnetic material to replace drivers 72, which generates a static magnetic field for driver response media to interact with. For magnetic field driving means, the driver response media is a plurality of patterned electromagnet devices such as electromagnetic coils or the like, which, under electric current provided by electric circuit 79, interacts to magnetic field generated by the sound driver. For electrical field driving means, the driver response media is electrode made of metal, conductive polymer, ITO or the like, carbon-nanotube, graphene, or the like. By connecting to outside voltage source through electric circuit 79, it is eventually electrically coupled with the electrical filed type sound driver and interacts to the driver through electrical field, similar to two electrodes interaction in parallel plate capacitor. The electric circuit 79 is only necessary to provide electrical connections to the electrode media, thus, simple and easy to make on the sound generating layer.

Figure 8A:
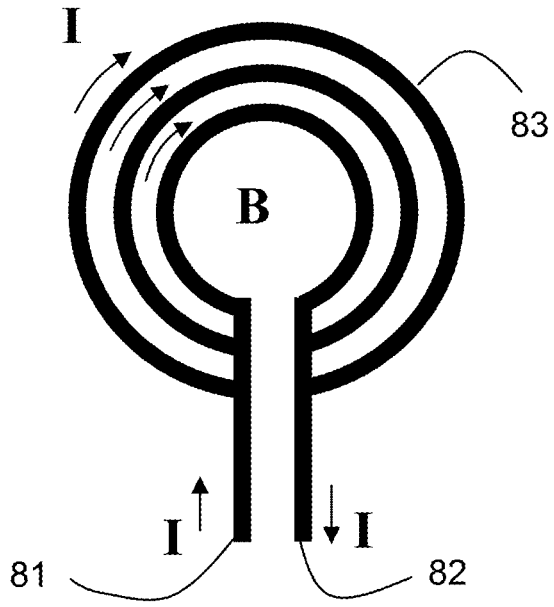
FIGS. 8A and 8B are illustrative design showings of electromagnetic coil useful for flat panel sounding unit array.
Figure 8B:
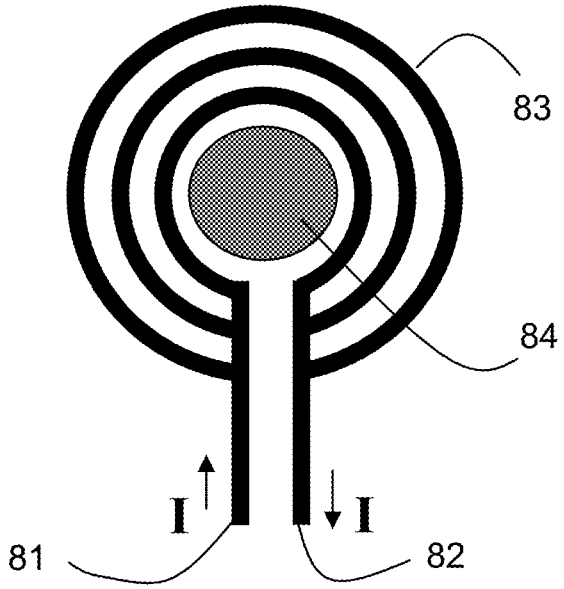

FIGS. 8A and 8B illustrate pattern designs of electromagnetic coils made of thin conductive film. Referring to FIG. 8A, coils consists of a plurality of concentric rings 83 with opening for current input 81 and output 82. When electric current is introduced into the rings, magnetic field along direction perpendicular to drawing surface is created and occupies area substantially enclosed by the most inner ring. Referring to FIG. 8B, a ferromagnetic pad 84 is made inside the most inner ring and substantially occupies available area but electrically insulted from the ring. With existence of central ferromagnetic core, the magnetic field created by electric current becomes much stronger. The ferromagnetic pad can be made with thin film semiconductor processing as well. The ring shape in the drawing is for illustration purpose. The coil can be any enclosing shape with opening to feed current in and out, for example, circle, oval, rectangle, square, or polygons. These electromagnetic coils are useful for both thin film sound driver and thin film sound generating layer.

Figure 9A:
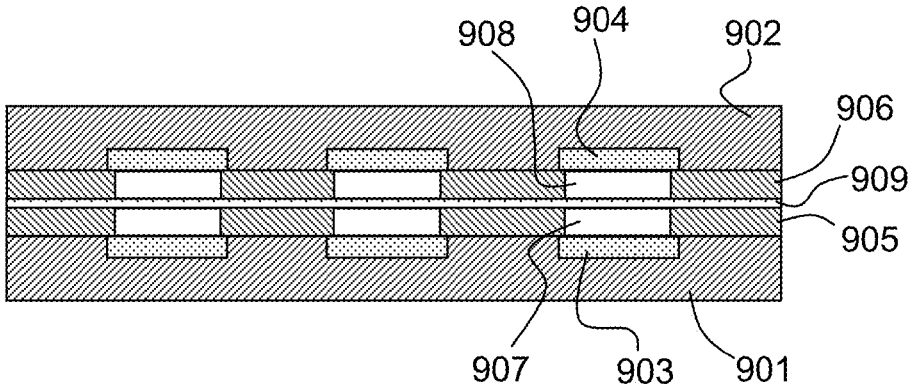
FIGS. 9A, 9B, 9C, 9D, 9E, and 9F illustratively show a variety of embodiments of flat panel sounding unit array based on semiconductor thin film fabrications, which are useful for flat panel displaying and sounding system in accordance with the inventions.

Referring to FIG. 9A, an embodiment of flat panel sounding unit array of integrated array type has two substrates 901 and 902, each having a plurality of sound drivers 903 or 904 respectively. The sound drivers 903 on substrate 901 face right to the sound drivers 904 on substrate 901. In between, a sound generating layer 909 sandwiched by spacer layers 905 and 906, which in turn are sandwiched by two substrates 901 and 902. Both spacer layers 905 and 906 have recessed surface regions adjacent and laterally aiming to the sound drivers to form cavities 907 and 908 respectively. The cavities provide vibrating spaces for layer 906. (The drawing illustrates an extreme case of the recess surface regions as hollow through layer body.) In operation, portions of layer 906 corresponding to cavity regions vibrate to generate sound waves under jointly driven effort of corresponding set of sound driver 903 and sound driver 904. It is reminded that two spacer layer 905 and 906 may not have the same layer thickness. It is reminded that sound driver 903 and sound driver 904 of one set may or may not be the same type. For example, the sound drivers 903 and 904 of one set may both be magnetic field type or electrical field type. Or, they may be one for magnetic field type and the other for electrical field type. If the sound drivers of one set are different type, the sound generating layer should be responsive to both types of drivers as well. The upper cavity 908 and lower cavity 907 may be coupled with fluidic channel (not shown) to balance pressures on two sides of layer 906. This is achievable by making a through hole on layer 906 accordingly. The embodiment may further contain sound transmission channels to guide sound waves out. This is achievable by making sound transmission channels through carrier substrates either at spare areas of driver or spacing areas between adjacent drivers. Comparing with single side driver embodiment, this double sides driver embodiment potentially outputs more powerful sounds and combines advantageous characteristics of both magnetic field type and electric field type sound drivers. To make the embodiment, each substrate containing its sound drivers and spacer layer is manufactured by semiconductor processing, and, then, assembly of the embodiment is completed by attaching the two substrates with the sound generating layer in between.

Figure 9B:
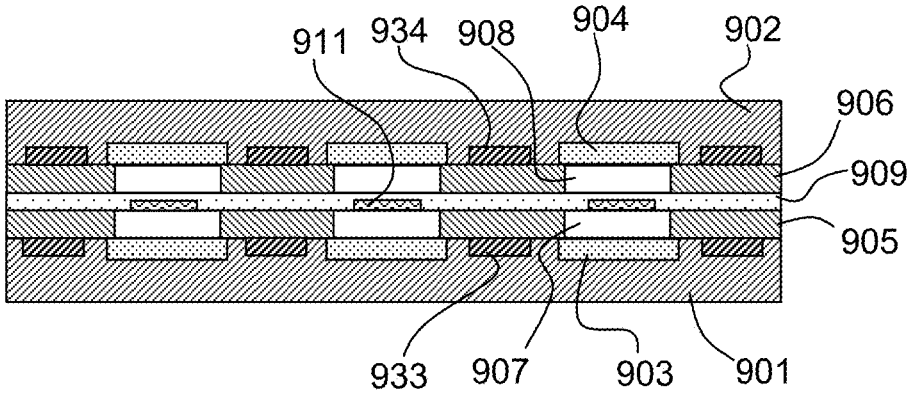

Another embodiment of flat panel sounding unit array of integrated array type contains all features of the embodiment referring to FIG. 9A and some additional features. Referring to FIG. 9B, sound generating layer 909 further embodies driver response media 911 at least substantially covering corresponding cavity areas, and, substrates 901 and 902 further have control circuits 933 and 934 respectively to drive corresponding sound drivers on the substrates. The control circuit and the sound drivers are made integratedly by thin film semiconductor processing. Driver response media 911 is substantially the same material and works substantially the same way as driver response material 78. However, in this embodiment, driver response media 911 interacts with both sides sound drivers. If two sound drives of one set are different types, driver response media 911 contains driver response medias of both types. For example, if one side sound driver is magnetic field type and the other side one is electrical field type, the driver response media should contain both ferromagnetic material or electromagnetic coil for magnetic field interaction and ions or electrode for electrical field interaction.

Figure 9C:
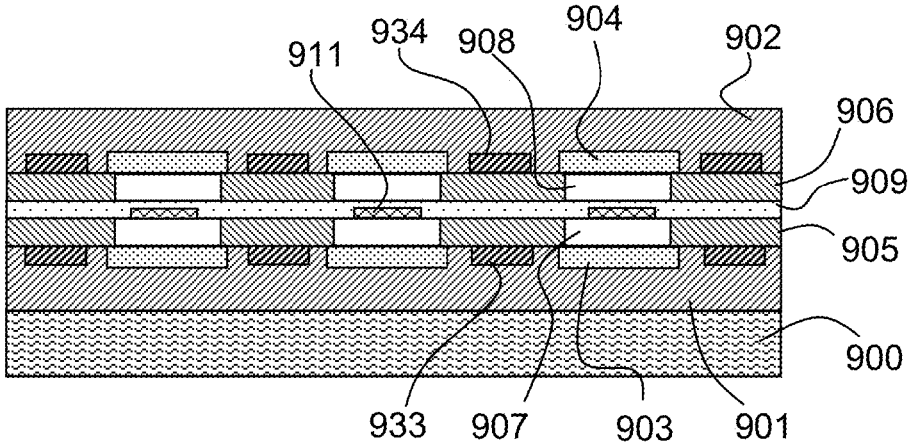

Referring to FIG. 9C, another embodiment of flat panel sounding unit array of integrated array type contains all features of the embodiment referring to FIG. 9B and, in addition, a light illumination layer 900 attached to substrate 901. Assuming substrate 901 transparent to light from light illumination layer 900, illumination layer 900 can set forth lights on driver response media 911. When UV light is in use by layer 900, ions of media 911 can be restored after initially contained ions decay through a period of use. For ferromagnetic material of media 911, controlled heating by illumination can remove magnetic memorizing effect on the media after the media exposes to driving magnetic field for a period of use.

Figure 9D:
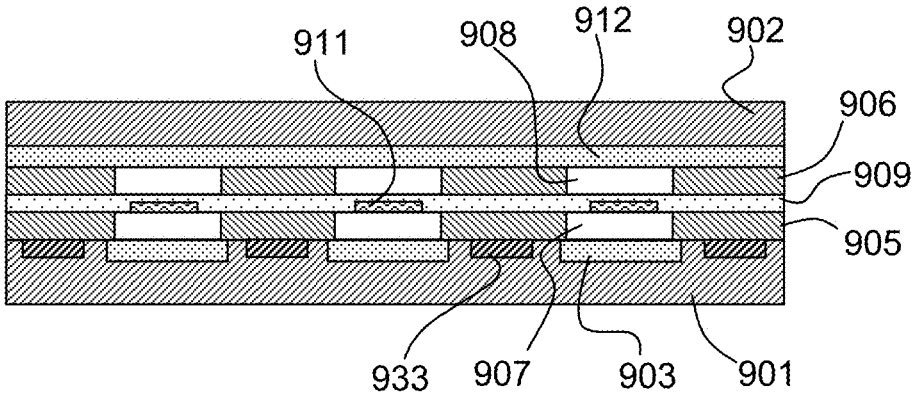

Referring to FIG. 9D, another embodiment of flat panel sounding unit array of integrated array has sound drivers on substrate 902 replaced with a driver assisting layer 912. The driver assisting layer 912 confines field energy generated by sound drivers to enhance the interaction between sound driver 903 and driver response media 911. If sound driver 903 is a magnetic field type, layer 912 is a magnetic material to confine magnetic field not permissible to outside. If sound driver 903 is a electrical field type, layer 912 is a conductive layer coupled with control circuit 933 internally or externally, thus establishing confined electrical field between driver 903 and layer 912. If sound driver 903 is an ultrasonic piezoelectric type, layer 912 is a ultrasound impermissible material to prevent ultrasound energy from passing. In order to facilitate audible sound coming out, the embodiment may further includes sound transmission channels through either one substrate. It is obvious that, if layer 912 is directly made on top of spacer layer 906, substrate 902 does not have to be present or used in making.

Figure 9E:
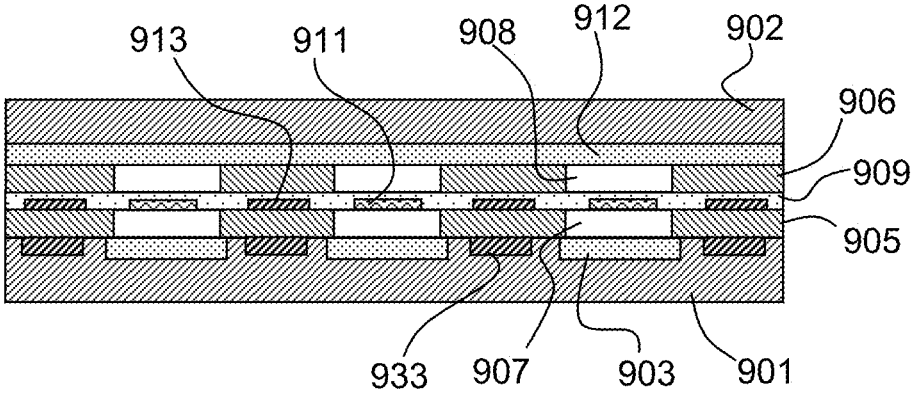

In another embodiment of flat panel sounding unit array of integrated array type, as illustrated in FIG. 9E, sound generating layer 909 further includes electric circuit 913 electrically connected to driver response media 911 and eventually coupled with control circuit 933 internally or externally. For electrical field driving mechanism, driver response media 911 is a conductive electrode. By varying electrical potentials on the drive response media, its interaction with the sound driver under enhancement from the driver assisting layer becomes stronger and more responsive to audio signals. For magnetic field driving mechanism, driver response media 911 is a plurality of electromagnetic coils, which interact with magnetic field generated by the sound driver when charged with electric current. Electric circuit 913 acts sufficiently by just connect media 911 to internal or external control circuitry. Thus, it is simple and should be easy to make on the body of sound generating layer 909.

Figure 9F:
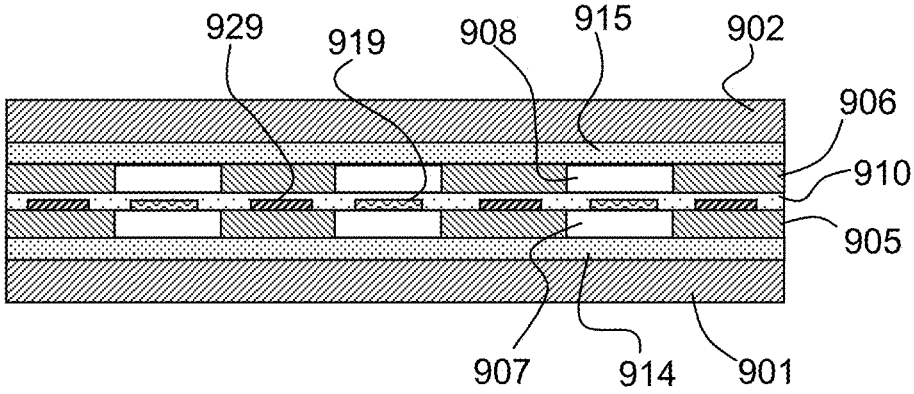

Referring to FIG. 9F, an embodiment of flat panel sounding unit array of integrated array has a sound generating layer 910 sandwiched by two driver assisting layers 914 and 915 with spacer layers 905 and 906 respectively presenting between each side of layer 910 and the corresponding driver assisting layer. The spacer layers have recessed regions to form cavities 907 and 908 for corresponding portion of layer 910 to be free to vibrate. (The recessed regions are shown as extreme case of hollow in the drawing.) In this embodiment, no obvious sound drivers presents, but, it is the sound generating layer to perform both roles of sound driver and driver response media under assistance of layers 914 and 915. Therefore, sound generating layer 910 includes driver and response media 919 and control circuit 929 connected to and driving the media. Portions of layer 910 containing Media 919 in corresponding cavity areas vibrate according to driving signals applied. For magnetic driving mechanism, layers 914 and 915 are ferromagnetic material to establish a built-in magnetic field in between. Driver and response media 919 is a plurality of electromagnetic coils, which interact with the built-in magnetic field when charged with electric currents of driving signals. When the electric current varies according to audio signal, the portion of layer 910 possessing the media and located in corresponding cavity area will vibrate to generate sound wave. To support above structures, the embodiment may only use substrate 901 with above structures built upon, or, use two substrates 901 and 902, each substrate on one side, to have above structures built upon accordingly.

It is to be understood that teachings of above embodiments about flat panel sounding unit array may be combined without deviating from spirits of the teachings to form embodiments other than explicitly shown in the drawings, which are considered to be included in this disclosure. It is to be understood, as well, that features presented in one embodiment may be used in other embodiments assuming no confliction of teaching. Thus, taking a feature or its equivalence disclosed in one embodiment into another disclosed embodiment or its obvious variants is an obvious variant of disclosed embodiments.

In accordance with the invention, we are going to discuss some specific embodiments of the flat panel displaying and sounding system according to conceptual principles and teaching spirits of aforementioned general embodiments.

Figure 10A:
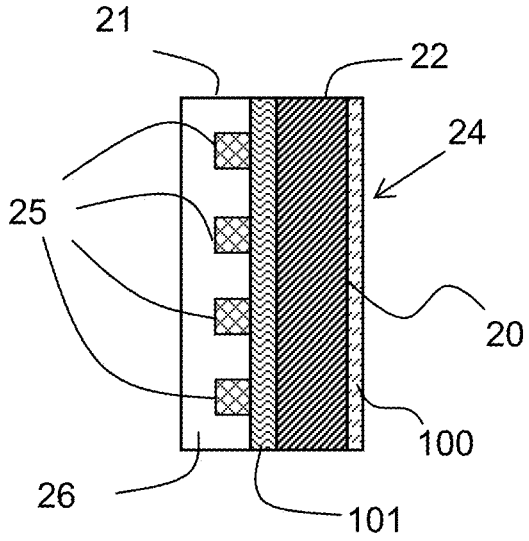
FIGS. 10A and 10B illustratively show some specific embodiments of the general embodiment illustratively shown in FIG. 2 for flat panel displaying and sounding system in accordance with the invention.

Referring to FIG. 10A, an embodiment of the flat panel displaying and sounding system, which is a detailed embodiment of aforementioned general embodiment illustratively shown in FIG. 2, comprises a sound impedance matching layer 101 between flat panel sounding unit array 21 and flat panel displaying layer 22. Sound impedance matching layer 101 matches sound impedance difference between the flat panel sounding unit array and the flat panel displaying layer to facilitate sound transmission from sound unit array to view side 24 of the system. Furthermore, the embodiment may further comprises a sound impedance matching layer 100 on viewing surface 20 of the displaying layer. Layer 100 facilitates sound output to ambient by matching sound impedance difference between the displaying layer and ambient air. Typically, sound impedance matching is to insert a layer or layers of material having intermediate density. It is a common practice for ordinary skilled artisan in field related to sound transmission properties of materials to find detail material compositions for sound impedance matching.

Figure 10B:
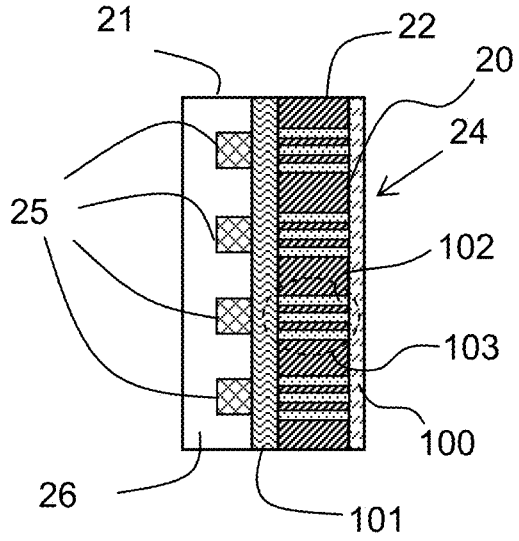

Referring to FIG. 10B, an embodiment of the flat panel displaying and sounding system, which is a detailed embodiment of aforementioned general embodiment illustratively shown in FIG. 2, has flat panel displaying layer 22 further comprising sound path groups 103 in array form corresponding to the sounding unit array of sounding panel 21. (For convenience, flat panel sounding unit array is called in short as sounding panel here and within the scope of this disclosure. The meaning of sounding panel is viewed, within the scope of this disclosure, to be the meaning of flat panel sounding unit array.) Each sound path group may comprise a plurality of sound path channels 102 or sound transmission passages. The sound path channels provide paths for audible sound waves generated by the sounding panel to pass through. The embodiment may further comprise sound impedance matching layer 101 between sounding panel 21 and displaying layer 22. The embodiment may further comprise sound impedance matching layer 100 on viewing surface of the system. The detail implementation of the sound path channels are further illustrated in an example for LCD type displaying layer in following paragraph.

Figure 11:
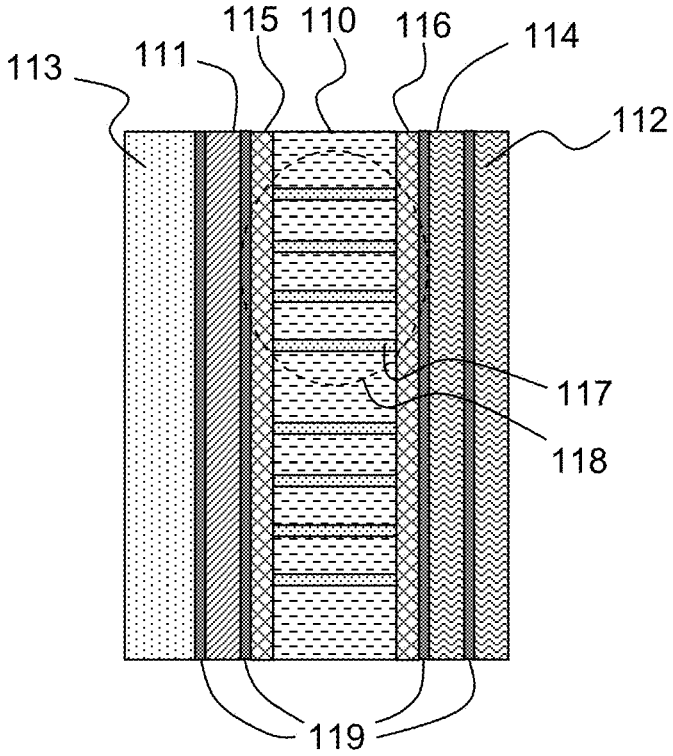

In an example to illustrate how to implement sound path channels in flat panel displaying layer, a LCD type displaying layer is chosen and illustrated in FIGS. 11 and 12. As stated previously in this disclosure, the flat panel displaying layer at least comprises the image pixel switching layer, which is liquid crystal (LC) polarization steering layer for LCD type flat panel display. In this example, for teaching purpose, the flat panel displaying layer, as shown in FIG. 11, comprises complete layers of LCD type flat panel display. From left side to right side in the drawing, it has backlight layer or illumination layer 113, first polarizer layer 111, electrode layer 115, liquid crystal layer 110, electrode layer 116, color filter layer 114, and, second polarizer layer 112, wherein layers 115, 110 and 116 collectively constitute LC polarization steering layer. Sound path channels 117 assorted into group 118 are present in liquid crystal layer 110 and may further extend through other layers of LCD panel. Making channels 117 can be accomplished by making these channels collectively act as spacers between two electrode layers. Normally, prefabricated precise diameter micro balls are dispersed between electrode layers as spacer. For such case, using a sound transmissible material for these spacer balls can have them performing as sound path channels. Thus, making sound path channels inside liquid crystal layer does not require more steps to make the LCD panel. For In-plane Switching LCD display, spacer is a patterned layer fabricated by semiconductor processing. For such case, making sound path channels can be as easy as modifying pattern design of the spacer layer. Furthermore, extending channels 117 through other layers requires to pattern through these layers accordingly. This may significantly increase panel making cost. One practical way is to insert sound impedance matching layers at interfaces where sound may be reflected due to impedance mismatch. The drawing illustrates such way by inserting sound impedance matching layers 119 at interfaces between adjacent layers.

Figure 12A:
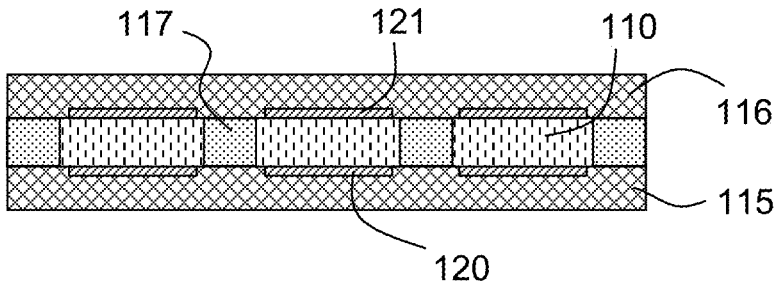
FIG. 12A, 12B, and 12C are schematic cross-sectional and top-view showings of arrangement of sound transmission passages on a flat panel displaying layer.
Figure 12B:
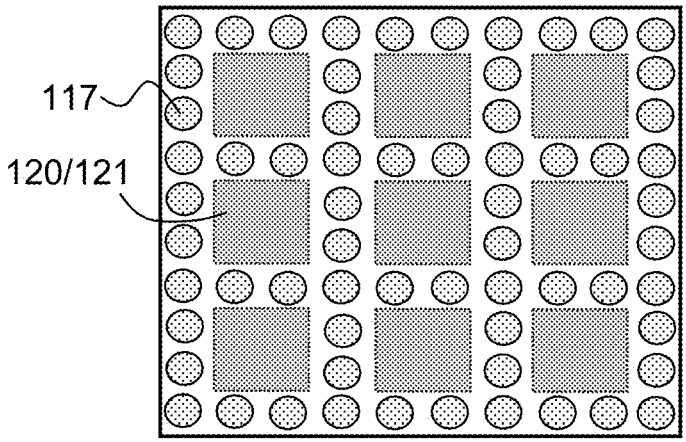
Figure 12C:
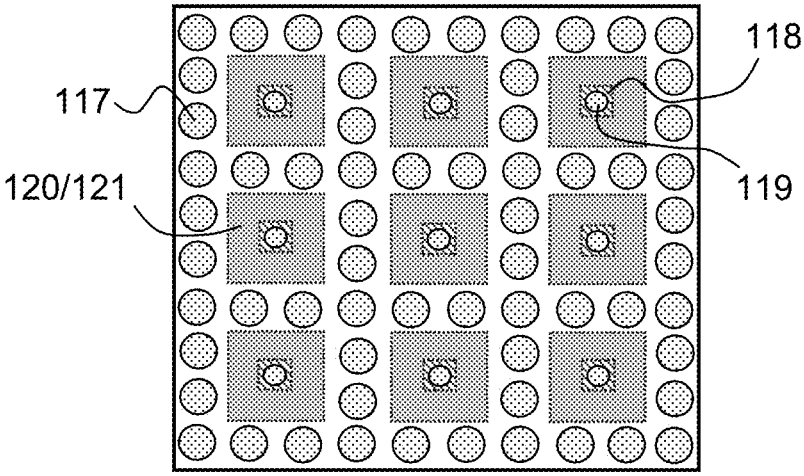

Sound path channels may be presented in non-lighting area of the displaying layer to avoid obstructing light or causing image distortion. Referring to FIG. 12A-12C, sound path channels can be formed at spacing regions of adjacent image pixels, thus not obstructing light outputs of image pixels. FIG. 12A illustrates cross-sectional view of LC polarization steering layer with sound path channels. Electrode layer 115 and 116 have transparent pixel electrode pads 120 and 121 fabricated by semiconductor processing. Most area of each pixel is occupied by the electrode pads. Imaging area of each pixel is the effective switching area controllable by the electrodes. Thus, there is always a spacing region between adjacent pixels that does not pass light. As shown in the drawing of FIG. 12A, sound path channels 117 are intentionally constructed in the spacing region. In the drawing, liquid crystals 110 are filled into empty spaces between adjacent channels. Top view of arrangement of sound path channels is illustrated in FIG. 12B. A plurality of sound path channels 117 are uniformly distributed along spacing region other than the pixel imaging areas. Therefore, possible detrimental effect on image quality due to existence of sound path channels is avoided or eliminated. The structure of sound path channels can be constructed by depositing a layer of sound transmission material on top of one electrode substrate, and, then patterning and etching the sound transmission layer. It is obvious that the structure of sound path channels performs as spacer layer between two electrode layers too.

For Active Matrix LCD (AMLCD), MOSFET transistor is built in each pixel area of one electrode layer and the other electrode layer is a common electrode which is uniform and not patterned into pixels. For In-Plane Switching LCD (IPSLCD), patterned electrodes are on one side and the other side electrode may not be necessary. Therefore, although the drawings of FIGS. 12A and 12B shows the case of two electrode layers, it is obvious for ordinary skilled artisan to implement the teachings of the illustrations for other cases such as AMLCD, IPSLCD or the like. Furthermore, for active matrix LCD or In-plate Switching LCD, the MOSFET transistor area for each pixel control are preferably allocated at the center of each pixel to allow a central sound path channel constructed at corresponding transistor area, thus render distribution of sound path channels more evenly and their structures more robust during operation. FIG. 12C illustrates the preferred allocation of transistor areas of pixel control. In the drawing, transistor area of each pixel control is located at central area 118 of each pixel. Central sound path channel 119 for each pixel is constructed correspondingly inside the transistor area. From the drawing, its is obvious that sound path channels distribute more evenly across pixel areas with existence of central sound path channels. During operation, sound waves may stress the attachment of the assembly. Having a post of central sound path channel to hold the assembly will surely make it more robust during operation. In addition, it is for drawing convenience that the sound path channels in the drawings have circular cross-section. The sound path channels can have any shape of cross-section, preferably to have circular cross-section.

Figure 13A:
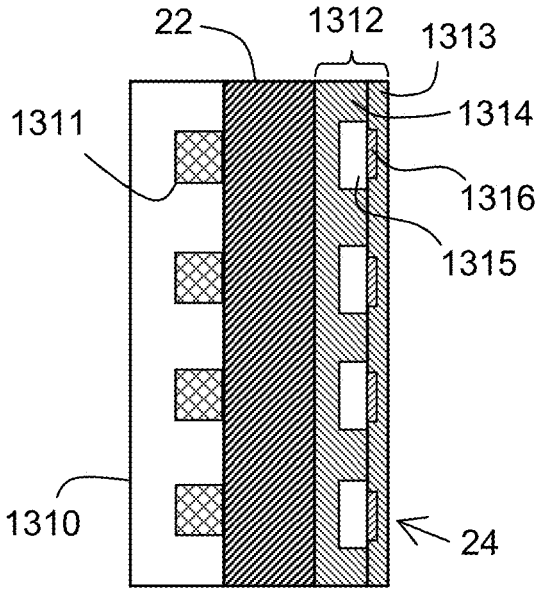
FIG. 13A, 13B, 13C and 13D illustratively show some specific embodiments of the general embodiment illustratively shown in FIG. 3 for flat panel displaying and sounding system in accordance with the invention.
Figure 13B:
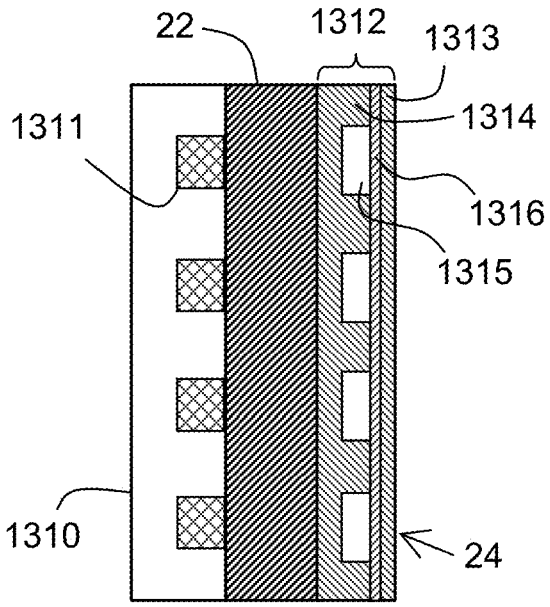
Figure 13C:
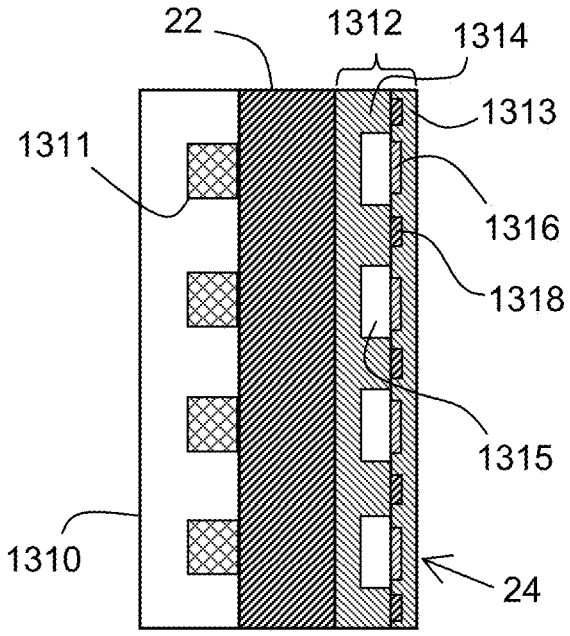

Referring to FIG. 13A, 13B, and 13C, an embodiment of the flat panel displaying and sounding system, which is a detailed embodiment of aforementioned general embodiment illustratively shown in FIG. 3, includes flat panel displaying layer 22, sound driver array panel 1310 attached to rear side surface of layer 22, and, a sound generating assembly layer 1312 attached to the front side surface of layer 22. The front side of layer 22 is the viewing side of displaying image, which is in consistent with view side 24 of the system. View side 24 of the system is the side toward viewer where both lights of images and sound waves come out. Panel 1310 contains array of sound drivers 1311. Sound generating assembly layer 1312 comprises sound generating layer 1313 and a cavity layer 1314. Cavity layer 1314 has recessed surface areas adjacent layer 1313 and laterally aiming to sound drivers 1311, thus forming a cavity 1315 opposing each driver 1311. The cavities provides free spaces for corresponding portions of layer 1313 to vibrate under driving means of corresponding sound drivers 1311. The sound generating layer contains driver response media 1316 that interacts with the driving means of the sound drivers. Driver response media 1316 may be dispersed in body material of layer 1313 or deposited on layer 1313. Furthermore, driver response media 1316 may occupy substantially corresponding cavity areas, as illustrated in FIG. 13A. The localized media may be deposited by shadow mask deposition of the media material using sputtering, e-beam evaporation or other vapor deposition techniques. It can also be made by thin file deposition, lithographic patterning and etching, similar to IC fabrication if cost to make is acceptable. Driver response media 1316 may be coated uniformly across the layer surface of layer 1313, as illustrated in FIG. 13B. The uniform coating layer of media 1316 can be easily made by thin film deposition on layer 1313, such as sputtering, e-beam evaporation, spraying, dipping, electrostatic adhering, gluing, or the like.

Sound driver 1311 and panel 1310 may be made by a variety of ways described in previous paragraphs regarding to embodiments of flat panel sounding unit array. For magnetic field driving means, the sound driver may be electromagnetic coils or electromagnets. The driver response media may be ferromagnetic material or electromagnetic coils, which responds to magnetic field generated by the sound driver. For ultrasonic driving means, the sound driver is piezoelectric transducer to generate ultrasonic waves in forward direction. The driver response media made of impermissible material to ultrasonic waves is to be urged by ultrasonic waves generated by the sound driver. For electrical field driving means, the sound driver may be electrode to be supplied with a voltage potential to generate electrical field. The driver response media is ions or electrode coupled to driver electrode to form a structure like parallel plate capacitor. Considering displaying layer 22 typically more susceptible to electrical field, electrical field driving means is considered disadvantageous to be used for the embodiment. Because magnetic field can easily penetrate through the displaying layer with very little or zero detrimental effect, magnetic field type sound drivers are preferred to be used for the embodiment.

In the embodiment as illustrated in FIG. 13C, comparing to the above embodiment, sound generating layer 1313 includes localized driver response media 1316 and control circuits 1318 connected to media 1316. The sound drivers in this specific embodiment are magnetic field type. Media 1316 is a plurality of electromagnetic coils. When charged by electric current directed by control circuit 1318, the electromagnetic coils respond to magnetic field generated by the sound drivers. There are a variety of ways to couple audio signals into the setup. One way is to couple audio signal into driving current of sound driver 1311, thus generating varying magnetic field for media 1316 to respond. Another way is to couple audio signal into electric current through the electromagnetic coils, then responding themselves in static magnetic field generated by the sound drivers, similar to working scheme of conventional diaphragm speakers. The other way is to couple audio signal both into the sound driver and into the electromagnetic coils, in which audio signal may be divided to best fit driving characteristics of each one. The sound driver array panel can be made either by assembling monolithic sound drivers into array on a carrier panel or by semiconductor thin film processing similar to IC processing, which are respectively described as monolithic array type or integrated array type in previous paragraphs regarding to embodiments of flat panel sounding unit array.

Figure 13D:
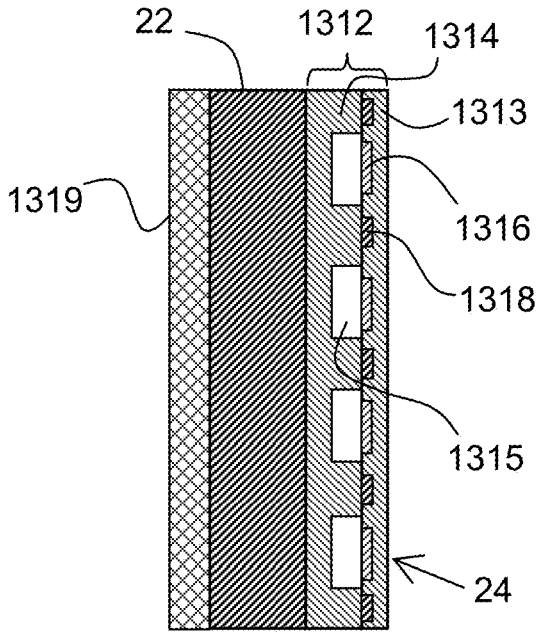

In the embodiment as illustrated in FIG. 13D, comparing to the above embodiment, the sound driver array panel is replaced with magnetic field layer 1319. In this embodiment, Media 1316 is a plurality of electromagnetic coils, and, control circuits 1318 connected to media 1316 couple audio signals into the electromagnetic coils. Magnetic field layer 1319 generates a static magnetic field for the electromagnetic coils to interact upon. Portions of layer 1313 where the electromagnetic coils lie on are driven to vibrate according to the input currents of audio signal. To generate the static magnetic field, magnetic filed layer 1319 may be a permanent magnetic layer made of ferromagnetic material or a electromagnetic layer, which generates magnetic field by supplying electric current in. The electromagnetic layer can, as whole, be a electromagnetic structure. Or, it can have a plurality of electromagnetic structures, for example coil structure, connected electrically in parallel, thus more robust to tolerate structure failure. The electromagnetic layer can be made onto the substrate constituting part of displaying layer 22 by thin film deposition, then, patterning and etching. It can also be made on a separate substrate and then, attached to displaying layer 22.

In order for lights of images of displaying layer 22 to pass through assembly layer 1312, layer 1312 must be transparent to visible light. To achieve the objective, cavity layer 1314 can be made of dielectrics or polymers, which are transparent. Sound generating layer 1313 can use transparent dielectrics or polymers as body material as well. However, driver response media 1316 demands some techniques to make it transparent. For magnetic filed driving means, when particles of ferromagnetic material constitutes media 1316, the particles should have particle sizes small enough not to noticeably scatter visible light but larger than average magnetic domain size and average spacing among the particles much larger than visible wavelength for light passing through. When media 1316 is a continuous film of ferromagnetic material, it can become transparent by patterning it as described in immediately following paragraphs. The magnetic domains in the ferromagnetic material are preferred to align to driving magnetic filed for better performance. This alignment can be done by applying an external aligning magnetic field either during making or during assembling. For electrical driving means, which, here, may severely affect normal operation of displaying layer 22 thus not preferred, the electrodes constituting media 1316 can use either transparent conductive material or metal layer patterned to become transparent. If ions constitutes media 1316, carriers of ions should be itself transparent or dispersed widely for not blocking light. For ultrasonic driving means, media 1316 can use high density dielectric material that is transparent or patterned to become transparent. In immediately following paragraphs, we will further discuss some general patterning techniques to get transparency.

Figure 14:
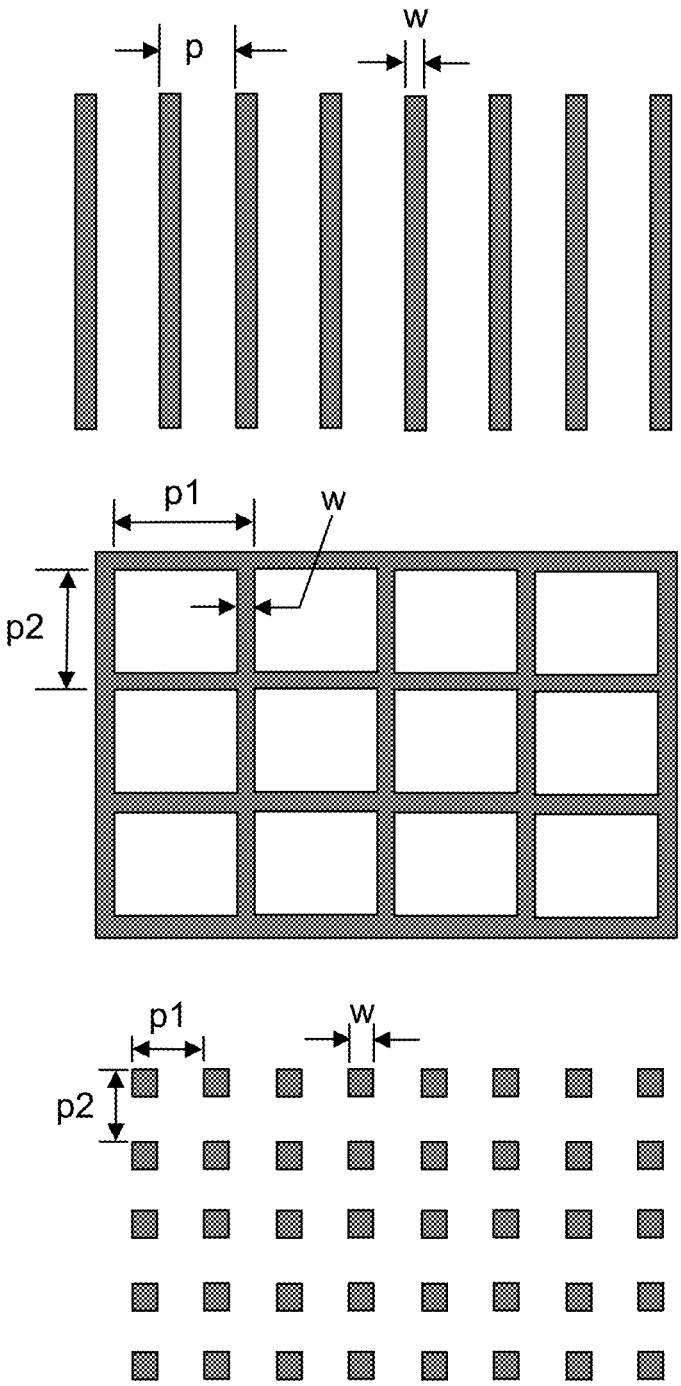
Figure 15A:
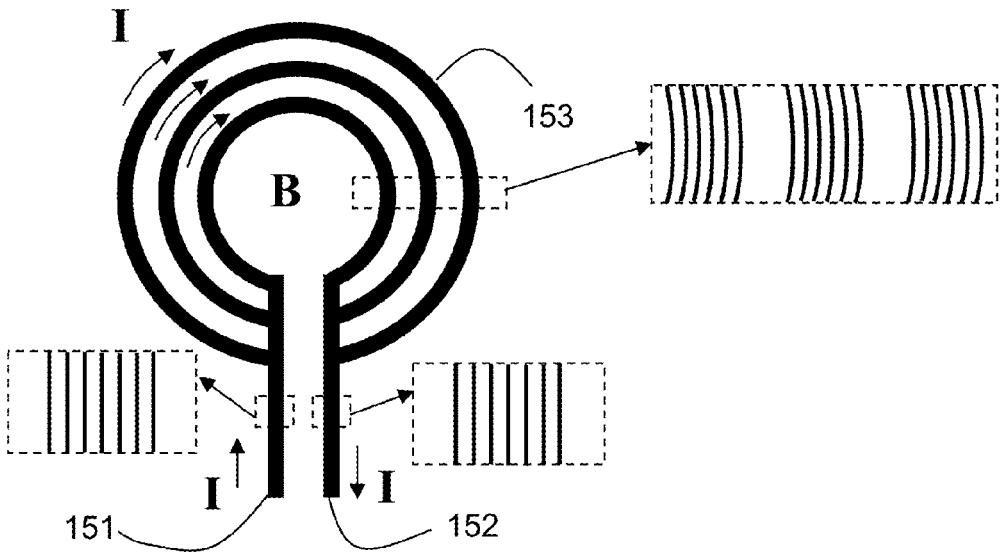
Figure 15B:
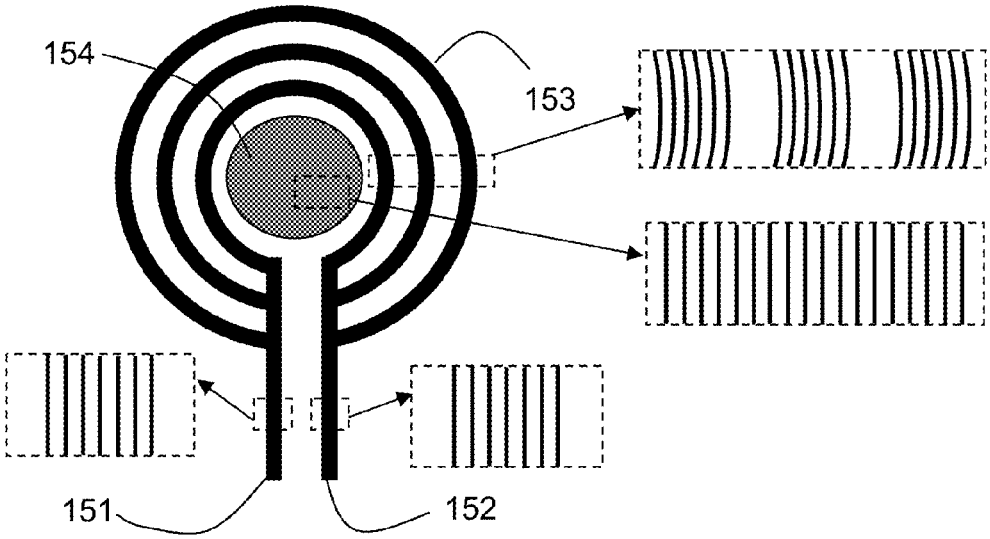
Figure 16:
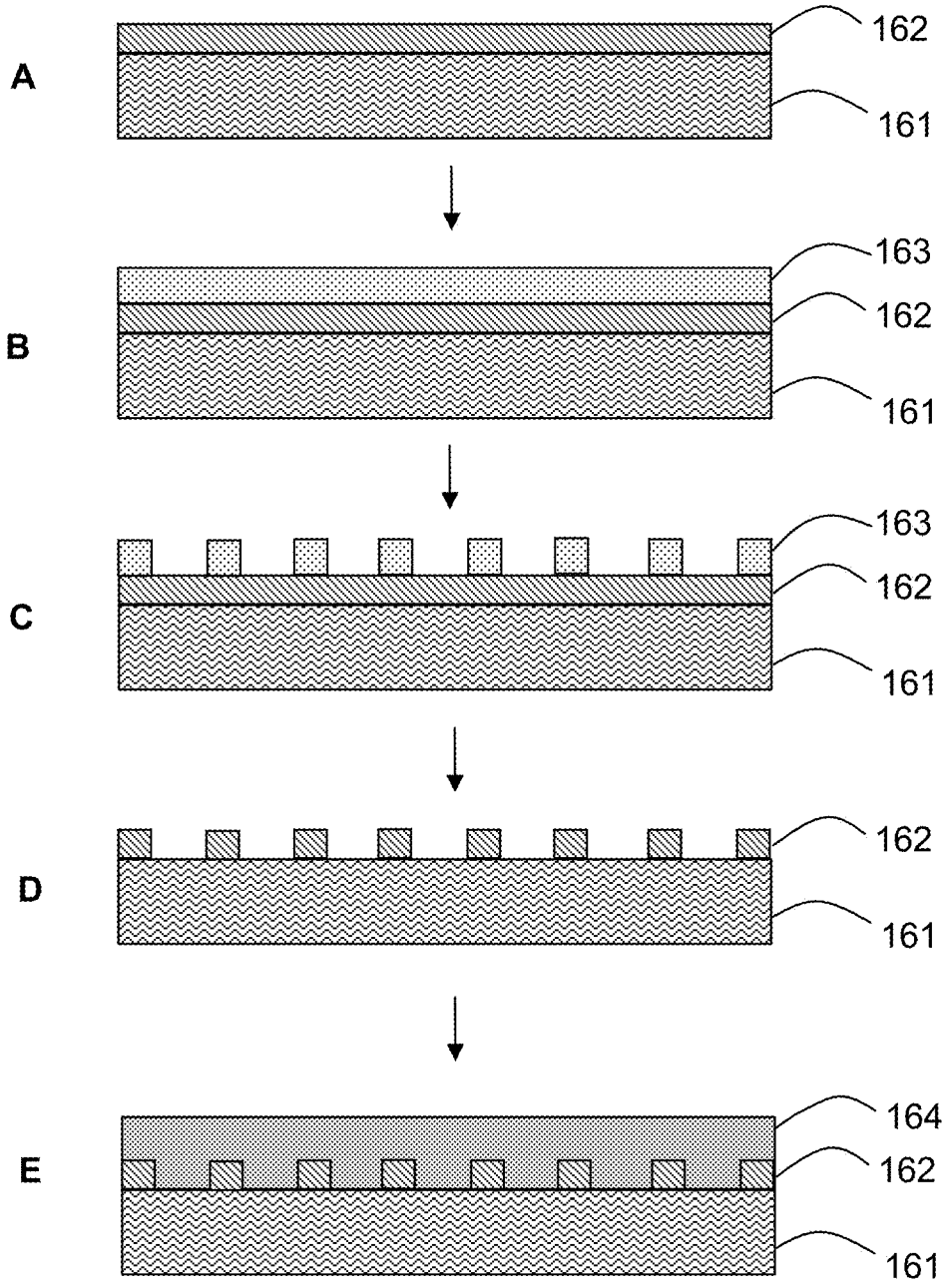
FIG. 16 illustratively shows fabrication process to make subwavelength grating or mesh for polarizer or transparency enhancement.

FIGS. 14, 15 and 16 illustrate some patterning techniques to make a metal layer transparent. These techniques can be used for any applicable case not limiting to metal layer. Common metal beneficial from the pattern techniques to make transparent layer is Al, Cu, Ni, Co, Ag, Au, Pt, Ti, Cr and other commonly used patternable metal.

According to FIG. 14, grating pattern, grid or mesh pattern, and dot array patterns illustrate commonly used patterns for making transparent metal layer. The key parameters for these patterns are spacing between adjacent elements and feature size of element. For grating pattern, they are grating period and line width represented as "p" and "w" respectively. For grid or mesh pattern, they are periods of grids and wire width represented as "p1 and p2" and "w" respectively. For dot array pattern, they are periods of dots and dot size represented as "p1 and p2" and "w" respectively. In general, conventional way obtaining certain transparency is to make the spacing much larger than light wavelength and the feature size sufficiently small to become invisible to human eyes. This method still holds its validity here. But, it requires certain occupying area ratio of patterns versus total in order to make the driver response media more susceptible to the driving means. Therefore, the spacing should be as small as possible while the feature size shrinking as well. To less affecting performance of the displaying layer, the feature size should be much smaller than pixel size of the displaying layer. For example, for displaying layer having pixel size about 100 microns, which is typical for current marketed display settings, the feature size may be 10 microns, thus element itself not blocking any significant amount of light coming out of displaying pixel. To have occupying area ratio 0.25, the spacing may be 40 microns for grating pattern, 80 microns for mesh pattern, or 20 microns for dot array pattern. Because the spacing is much larger than visible light wavelengths, color balancing of displaying layer is retained. For mobile devices with higher definition displays, the pixel size may be as small as 50 microns. Even so, the method works as well by reducing the spacing and the feature size accordingly and still meeting criteria of the teaching. If, in the future, any display desires a pixel size about or less than 10 microns, this method may be implemented in such way to position element features of the pattern overlaid in alignment with corresponding blocked areas of control circuits of displaying pixels and repeat periodically according to period of displaying pixels. Such implementation eliminates possible light blocking. Of course, for any case, the way of such implementation can be used in additional to the non-overlay way to further improve responsiveness of the patterned media. For example, the patterned media has a set of periodic features such as grating, grid or mesh or dots or the like without alignment to pixel locations, and another set of periodic features overlaid with alignment to pixel non-lighting areas. The example is advantageous in performance, but increasing complexity in making and assembling. The patterns may be made by photolithography and etching or lift-off. Although other lithography of semiconductor processing can be used too, photolithography is obvious the best choice to use for its simplicity and low cost.

In general, comparing to above conventional way, another way obtaining certain transparency is to make the spacing much less than light wavelength. Thus the patterns perform as subwavelength optical element (SOE). In order to achieve broadband flat performance for visible wavelength range and good transparency, the spacing of grating, grid or mesh, or dot array, or the like, must be three or more times less than light wavelengths, and the feature size should render an occupied area ratio equal to or less than about 50%, preferably equal to or less than about 30%. Thus, for visible wavelength range, the spacing or often called period should be less than 150 nm. The complexity of making this type of nanostructures across large area by nanofabrication increases dramatically when smaller spacing or period is pursued. For the reason, although the smaller period the better performance, a preferred setting of subwavelength optical structure has a period or spacing about 70 nm and feature size about 35 nm or less. A variety of technologies can be used to make the nanostructure if cost of making is set aside. Deep UV (DUV) optical stepper lithography, EUV optical stepper lithography, electron beam lithography (EBL), X-ray lithography, interference lithography or holographic lithography, nanoimprint lithography (NIL), nano-stencil lithography, and other emerging nanolithography are all able to produce the nanostructure. Among these technologies, nanoimprint lithography is a very practical way to reduce large area cost of making the nanostructure, wherein, a master template produced by other lithography replicates its patterns of nanostructure precisely and cheaply onto end-use substrates. It is to be understood that, for purpose of making the driver response media, the patterns do not require lines or wires are continuous across a large area. Thus, a large area pattern may be constituted of many die areas. These die may be adjoined with a spacing between adjacent dies. They may be stitched together without having to stitch lines or wires of die patterns. Optical lithography stepper, X-ray lithography stepper, or interference lithography stepper is readily available to do that when stitching lines or wires is not needed.

When driver response media 1316 is made of a plurality of electromagnetic coils, the related structure should have certain transparency as well. According to FIGS. 15A and 15B, electromagnetic coils, similar to illustrations of FIGS. 8A and 8B, improve visible transparency by making each metal wire as a group of metal wires of subwavelength optical grating. In overview, each wire 153 of electromagnetic coil is spaced from adjacent wires. The conventional way to obtain certain transparency described in the second immediately above paragraph can be referred to make the coil transparent. In detail, wires 153 and input/output wires 151 and 152 are all made of subwavelength grating wires. Each wire on its own becomes more transparent, thus improving overall transparency. FIG. 15B illustrates ferromagnetic core area 154 is, in detailed view, made of subwavelength grating wires to make it transparent as well. The area 154 may be made of subwavelength grid or mesh or dot array (not shown) for its intended use. Furthermore, when sound driver is desired to be transparent, above teaching about making electromagnetic coils transparent is useful for achieving that as well.

FIG. 16 illustrates a common process to make subwavelength optical structures. The process starts to deposit a metal layer 162, for example Al, Au, Co or Ag, on a substrate 161, by sputtering, CVD or e-beam evaporation. Then, a resist layer 163 for next lithography step is applied on top surface. After that, lithography step is performed to pattern resist layer 163. Following that, metal layer 162 is etched by a variety of removing techniques such as RIE (reactive ion etching), wet etching, or ion beam etching or milling. Then, resist layer 163 is removed by wet etching or RIE. So far, Patterned metal structure 162 is obtained on substrate 161. The metal structure may be further protected by depositing a passivation layer 164 by sputtering, CVD or e-beam evaporation. The passivation layer is typically dielectrics for electrical insulation and optical transparent. The top surface of passivation layer 164 may be planarized using CMP (chemical mechanical polishing) if necessary. As not shown, another common process is a lift-off process, in which, metal layer is deposited on top of patterned resist layer, then lifted off in solvent to remove the resist layer, leaving metal patterns on substrate areas directly exposed to metal deposition thereon.

Among the embodiments illustrated in FIG. 13A, 13B, 13C, and 13D, the embodiment illustratively shown in FIGS. 13C and 13D are preferable to others.

Now, in accordance with the invention, we will discuss several specific embodiments of the flat panel displaying and sounding system based on LCD type display, as accordingly illustrated in from FIG. 17 to FIG. 22.

Figure 17:
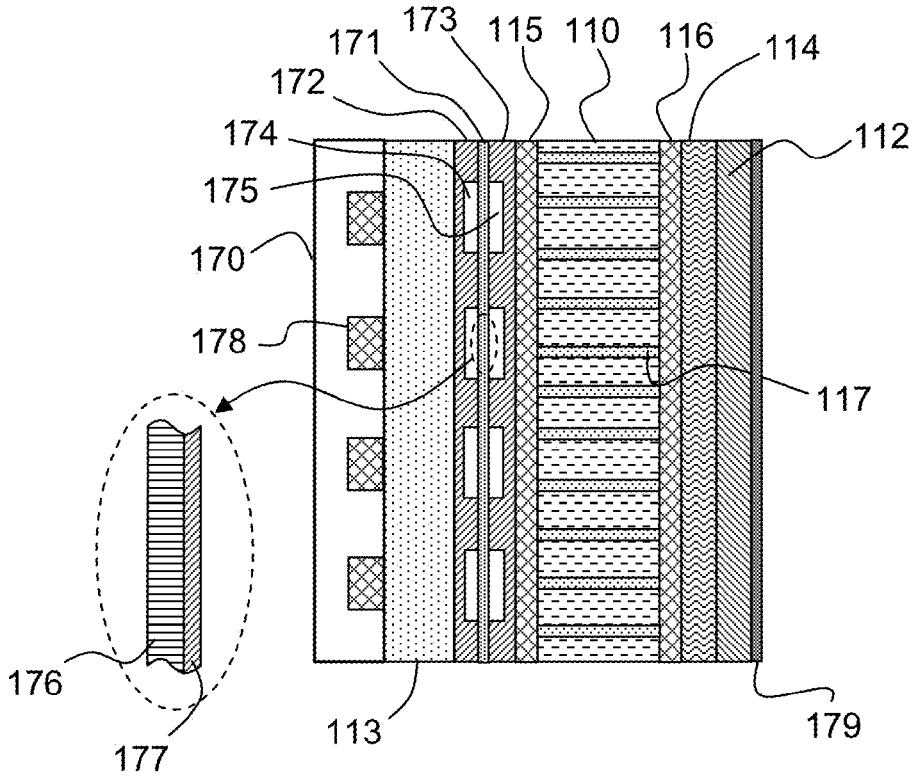
FIGS. 17, 18, 19 and 20 illustratively shows some detailed embodiments of flat panel displaying and sounding system based on LCD type display, in accordance with the invention.

In accordance with the invention, referring to FIG. 17, an embodiment of the flat panel displaying and sounding system comprises, from left side to right side in the drawing, sound driver panel 170, backlight layer or illumination layer 113, cavity layer 172 having cavities 174, sound generating polarizer layer 171, cavity layer 173 having cavities 175, electrode layer 115, liquid crystal layer 110 containing sound path channels 117, electrode layer 116, color filter layer 114, front polarizer layer 112 and sound impedance matching layer 179. Sound driver panel 170 embodies a plurality of magnetic field type sound drivers 178 in array form. Cavities 174 corresponds to cavities 175 one to one. Each set of them laterally aims to one sound driver 178, thus providing space for corresponding portion of layer 171 to vibrate under driven by the sound driver. Layer 171, as illustratively shown in the detail view of FIG. 17, has a grating layer 177 on a carrier layer 176. Carrier layer 176 provides mechanical support and flexibility for vibration. Grating layer 177 is a ferromagnetic metal wire grating structure acting as both a subwavelength optical polarizer layer for LCD display and the driver response media working with sound driver 178. Therefore, by using one step of patterning, layer 171 obtains sound driver response media and replaces one of two polarizer layers required for LCD display. For backlight passing through, carrier layer 1765 should be made of transparent material, such as dielectrics or transparent polymer. As described previously, portions of layer 171 within cavity areas may have regions cut-off for easy vibration like diaphragm in traditional speakers. Sound impedance matching layer 179 assists sound wave going out into air.

When LED matrix illumination is used for LCD display, the illumination layer and the sound driver panel can be combined into one panel. In another embodiment illustrated in FIG. 18, combined panel 184 contains both matrix of LED units 187 for LCD backlight illumination and array of sound drivers 185. Other features are similar to those already presented in the embodiment illustratively shown in FIG. 17. By combining sound driver panel and LED backlight together, manufacturing time and cost are both reduced.

Figure 18:
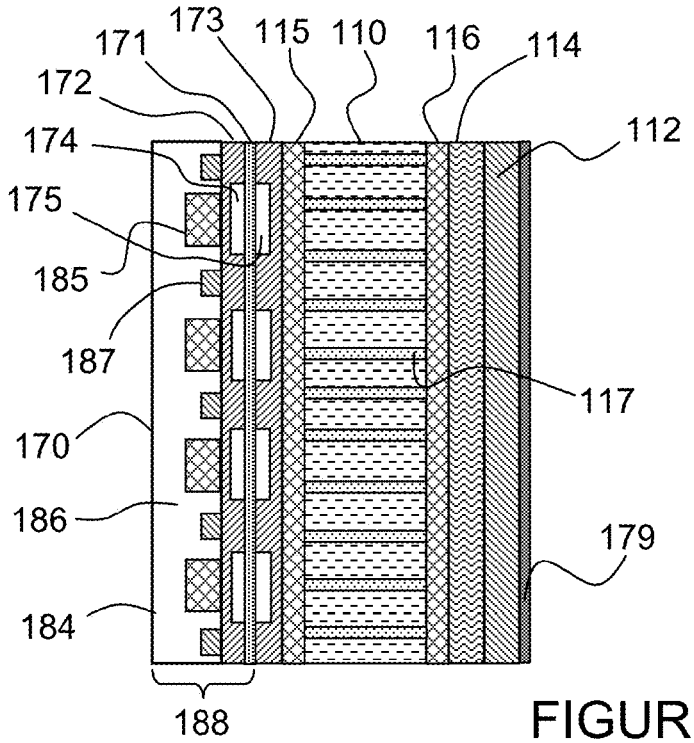

According to what is shown in FIG. 18, assembly 188 is, here, viewed as one subsystem of the disclosed system in accordance with the invention, but may have its own standalone application as a flat panel sounding and lighting system. Assembly 188, comprising carrier panel 186, matrix of LED units 187, array of sound driver 185, cavity layer 172 and sound generating layer 171, constitutes an independent flat panel system for both sounding and lighting. An alternative embodiment of the flat panel sounding and lighting system has the sound driver array placed on one side of a substrate and the LED matrix placed on the other side of the substrate. The embodiment has the similar arrangement of the cavity layer and the sound generating layer as assembly 188. It is to be understood that presence of cavity layer next to sound generating layer is to facilitate the layer to make sound. The LED matrix of above embodiments of the flat panel sounding and lighting system can be replaced with an OLED lighting layer, which is made of OLED structures for lighting or illumination. The OLED lighting layer may be used for LCD backlight as well. To improve lifetime, the OLED lighting layer may be divided into multi lighting regions so that failure of one region won't cause whole area out of working. These lighting regions may have separate controls to permit their lighting intensities relatively adjustable. Furthermore, the flat panel sounding and lighting system can be made by attaching a lighting layer to sounding side surface of a flat panel sounding unit array that is described in other paragraphs of this disclosure. One embodiment may be to dispose a lighting layer adjacent and overlying sounding units of a flat panel sounding unit array, similar as what is illustratively shown in FIG. 2 except having the lighting layer hereof to replace the flat panel displaying layer in the drawing. The flat panel sounding unit array is described in other paragraphs of this disclosure, primitively in paragraphs associating with the figures from FIG. 5 to FIG. 9. In an example of the embodiment, which has the sounding unit array as illustrated shown in FIG. 7, the lighting layer may be presented on the sound generating layer, preferably on its outer side surface. Here, the lighting layer is preferably an OLED lighting layer. For using, the flat panel sounding and lighting system can be embedded in or hung on wall of building for playing audio media and lighting. The lighting and sounding may operate independently or correlate in timing or to mix sensational impacts of lighting and sounding for special user experience effect. For one example, tuning lighting output of LED matrix is coordinated with surround sounding effect created by sounding unit array. For another example, tuning lighting output of each LED or a group of a plurality of LED for a panel area provides a viewing effect pattern coordinated with sounding outputs of sound units corresponding to the same area, rendering user a spatially coupling experience between them. For another example, dividing LED matrix into groups and tuning output of each LED group to form a viewing effect pattern is coordinated with surround sounding effect created by sounding unit array. The teaching of the related features in other paragraphs of this disclosure, although presented for the flat panel displaying and sounding system, is considered valid and available to make and use such flat panel sounding and lighting system, therefore, referred here.

Figure 19:
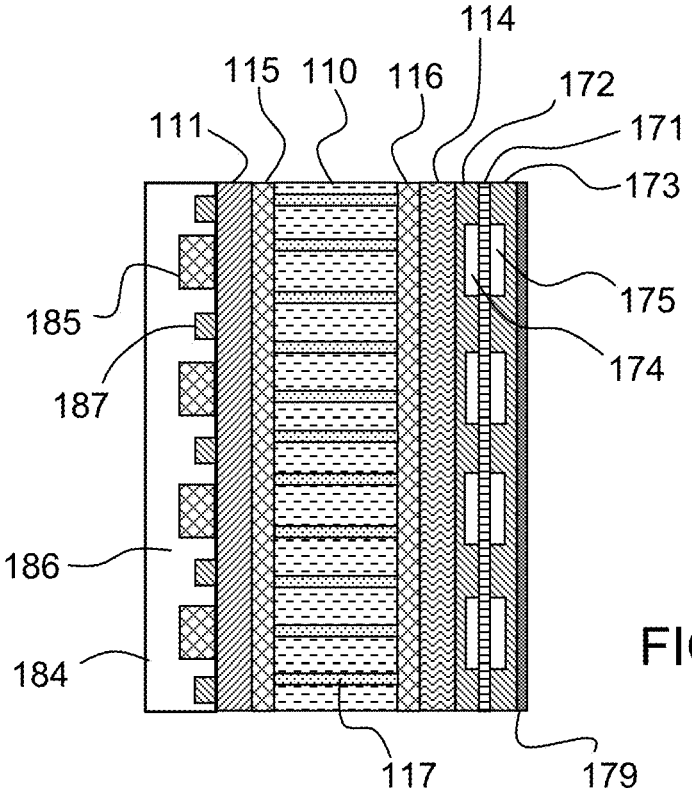

In accordance with the invention, referring to FIG. 19, an embodiment of the flat panel displaying and sounding system comprises, from left side to right side in the drawing, combined panel 184 having matrix of LED units 187 and array of sound drivers 185, rear polarizer layer 111, electrode layer 115, liquid crystal layer 110, electrode layer 116, color filter layer 114, cavity layer 172 having cavities 174, sound generating polarizer layer 171, cavity layer 173 having cavities 175, and sound impedance matching layer 179. Sound drivers 185 are preferred to be magnetic field type or ultrasonic wave type. When ultrasonic type is chosen for sound driver 185, liquid crystal layer 110 may further contain sound path channels 117 to facilitate ultrasonic waves passing through. Layer 171 may further contain driver response media for ultrasound driving means. Comparing with the embodiment illustratively shown in FIG. 18, primitive change is to move subassembly of layer 171 and cavity layers 172 and 173 forward to replace the front polarizer layer and insert rear polarizer layer 11 in place correspondingly.

Figure 20:
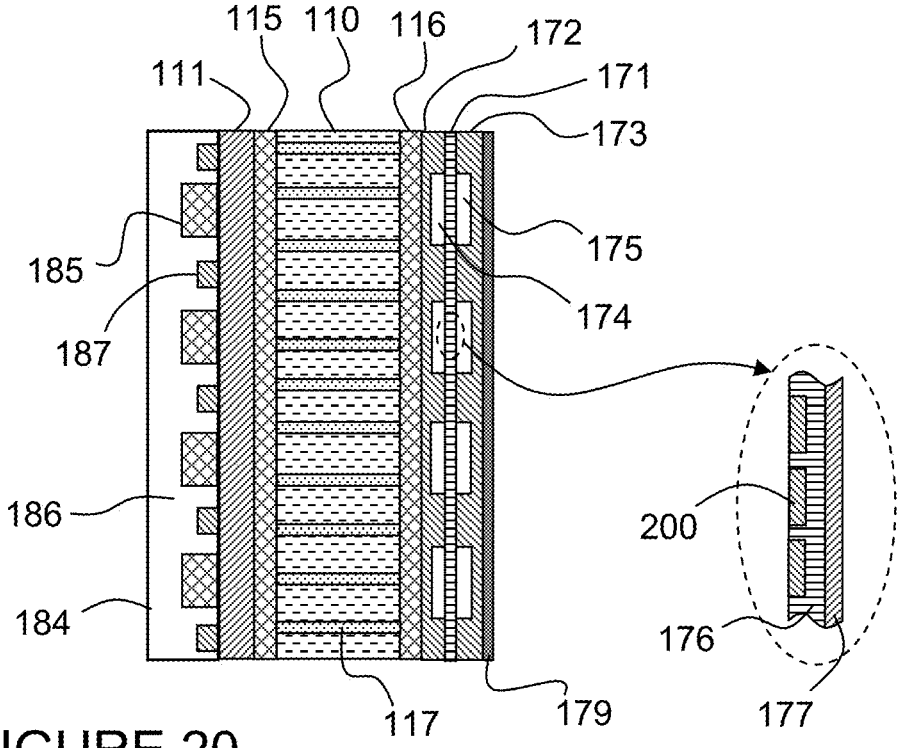

Furthermore, color filer layer 114 may have its function integrated into layer 171, thus reducing complexity of manufacturing and assembling. FIG. 20 illustratively shows an embodiment having all characteristics of the above embodiment illustratively shown in FIG. 19 except no longer having color filter layer 114. Here, the functionality of color filter layer 114 is merged into layer 171. In detailed view of layer 171, color filter pixels 200 are presented on carrier layer 176 of layer 171. The color filter pixels should be aligned properly to displaying pixels of LCD. Dying method by inkjet printing can be used to make these color filter pixel. Alternatively, not as shown, the color filter pixels may be made on top of polarizer layer 177 with an intermediate layer in between.

Figure 21:
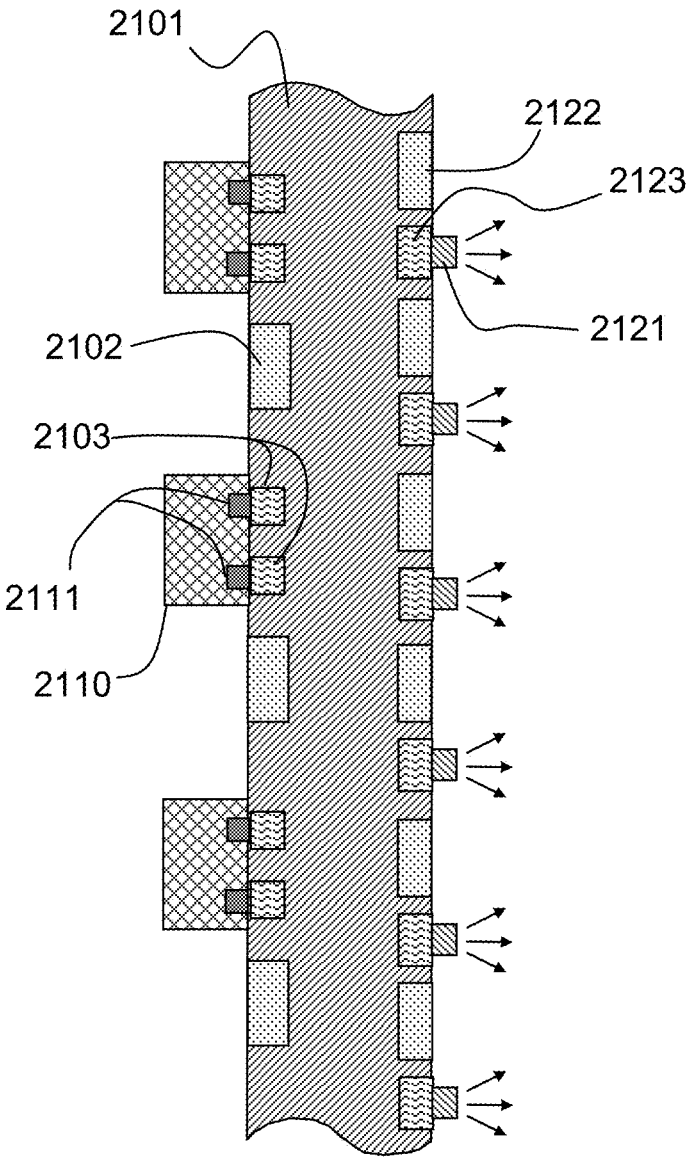
FIG. 21 illustratively shows cross-sectional view of a combined panel of sound driver array and backlight LED lighting on two sides.

An alternative embodiment of combined panel of LED matrix and sound driver array takes advantages of two side placements on a common carrier substrate with front side for LED matrix and rear side for sound driver array. Thus, placements of LED matrix and sound driver array won't interfere with each other. Furthermore, existing or maturing placement designs of LED matrix can be taken immediately without modification or with minimal modification. Control circuitry of LED matrix is separated away from control circuitry of sound driver array, minimizing electrical interference between them. In accordance with the embodiment, FIG. 21 illustratively presented a common carrier substrate 2101, matrix of LED units 2121 mounted on front side surface of substrate 2101, and array of sound driver 2110 mounted on rear side surface of substrate 2101. Here, front side of substrate 2101 is assumed the side to be lighten and where sound generating layer is to be placed. The front side surface of substrate 2101 has control circuits 2122 to control lighting output of LED units 2121. LED units 2121 are placed onto mounting pads 2123 which are electrically connected to control circuits 2122. The rear side surface of substrate 2101 has control circuits 2102 to drive sound drivers 2110. Sound drivers 2110 are attached to mounting places on substrate 2101 with their control inputs 2111 electrically bonded to electric contacts 2103 that are connected to control circuits 2102. In one example of making, substrate 2101 is a PCB board with both sides having control circuitries made by printing circuit techniques. Then, monolithically produced sound drivers 2110 and LED units 2121 are placed onto the substrate using standard PCB mounting processes. It is preferred to mount LED units 2121 on one side first, then to mount sound drivers 2110 on the other side. Solder reflow step or the like step may be performed one time for both sides after mounting on both sides are finished. Combined panel of LED matrix and sound driver array presented in the embodiment and its obvious variants is useful for the flat panel displaying and sounding system based on LCD type display that needs backlight. Furthermore, the combine panel is also useful for the flat panel sounding and lighting system described above.

Figure 22A:
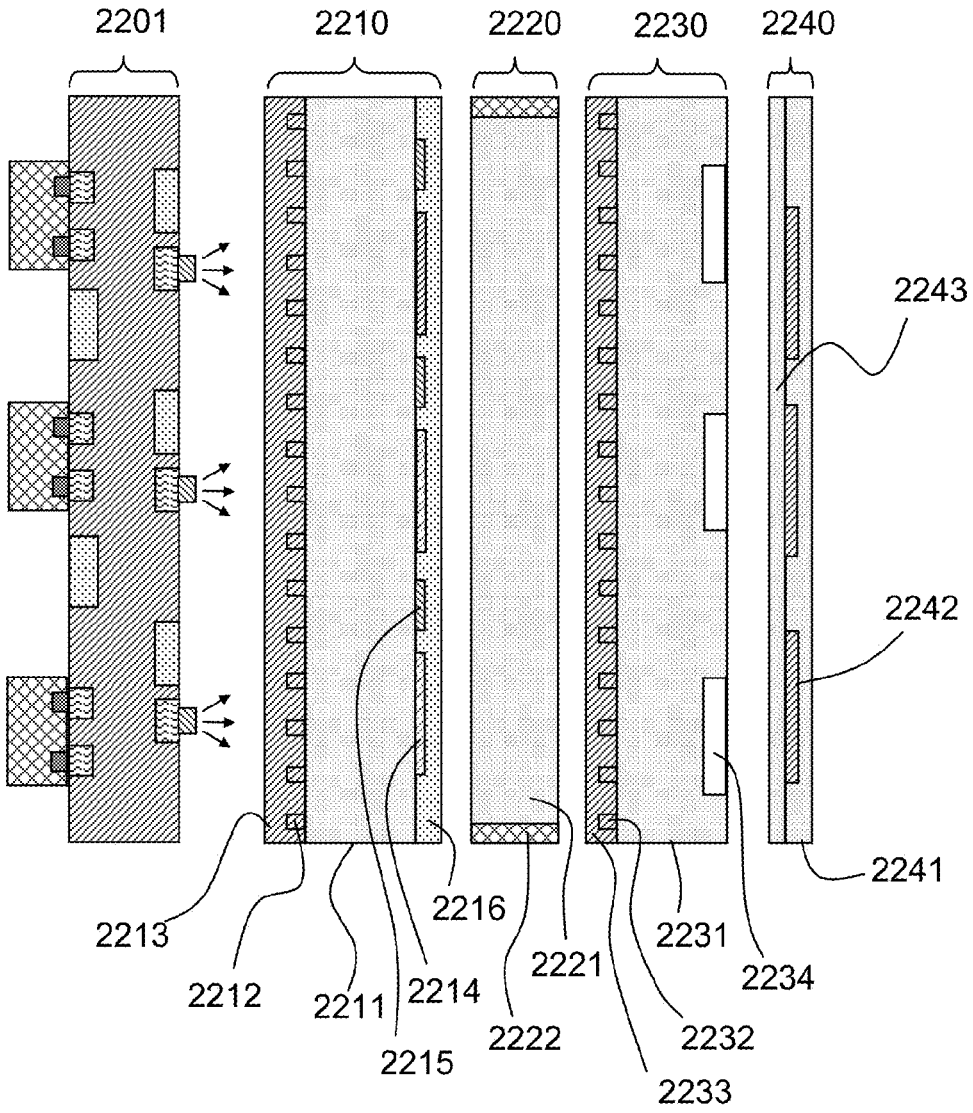
FIGS. 22A and 22B illustratively show some detailed embodiments of flat panel displaying and sounding system based on active matrix LCD type display and in-plane switching (IPS) LCD type display respectively, in accordance with the invention.

In accordance with the invention, an embodiment of flat panel displaying and sounding system is illustratively presented in FIG. 22A, which is based on active matrix LCD display, thin layer of subwavelength optical polarizer, and combined panel of LED matrix and sound driver array. The embodiment comprises, from left side to right side of the drawing, combined panel 2201 having LED matrix and sound driver array as illustrated in FIG. 21, control panel 2210, liquid crystal layer 2220, cover panel 2230 and sound generating integration layer 2240. Control panel 2210 has one side of substrate 2211 fabricated with metal grating wires 2212 acting as subwavelength optical polarizer, and, the other side of substrate 2211 fabricated with active matrix TFT (thin film transistor) layer. The metal grating wires may be protected by placing a passivation layer 2213 on top. The active matrix TFT layer typically contains active matrix addressed TFT circuits 2215 and pixel electrodes 2214, and may further have a passivation layer 2216 on top for insulation. Substrate 2211 is typically thin glass or quartz substrate. Liquid crystal layer 2220 is formed during assembling by filling liquid crystal 2221 into space between panels 2210 and 2230 separated by spacers 2222. Cover panel 2230 has one side of its substrate 2231 fabricated with metal grating wires 2232 acting as subwavelength optical polarizer and a protection layer 2233 on top. To form common electrode for active matrix control for LC steering, one way is to connect metal wires 2231 together either at periphery of panel or at boundaries of die areas that periodically divide the wires. Another way is to make protection layer 2233 of transparent conductive material, for example, ITO or the like, or, conductive polymer. In this way, layer 2233 acts as common electrode. Another way is to construct metal wires 2231 on or embed metal wires 2231 in an transparent conductive layer acting as common electrode. An insulation layer may be presented between the conductive layer and metal wires 2232 if it is necessary to decouple functioning of the two. The other side of substrate 2231 contains cavities 2234 laterally aiming to the sound drivers. These cavities are intended to give spaces for layer 2240 to vibrate. The cavities may be made by photolithography and etching or by laser machining, or, by injection molding if substrate 2231 is moldable. Substrate 2231 is typically thin glass or quartz substrate and may here be thin polymer substrate as well. Sound generating integration layer 2240 integrates functionality of color filter layer with functionality of sound diver response media. In the drawing, layer 2240 contains layer of driver respond media 2243 on body layer 2241 and further has color filter pixels 2242 contained. For assembling, panel 2201, panel 2210, panel 2230 and layer 2240 are manufactured separately and attached together to form a flat panel system. A preferred assembling sequence is as following: attaching panel 2210 to panel 2230 with spacers 2222 in between; filling in liquid crystal 2221 into intermediate space of the assembly; attaching layer 2240 onto the assembly; and, attaching panel 2201 to complete the assembly. This sequence is consistent with typical LCD assembling process except component panels used for assembling are different.

Figure 22B:
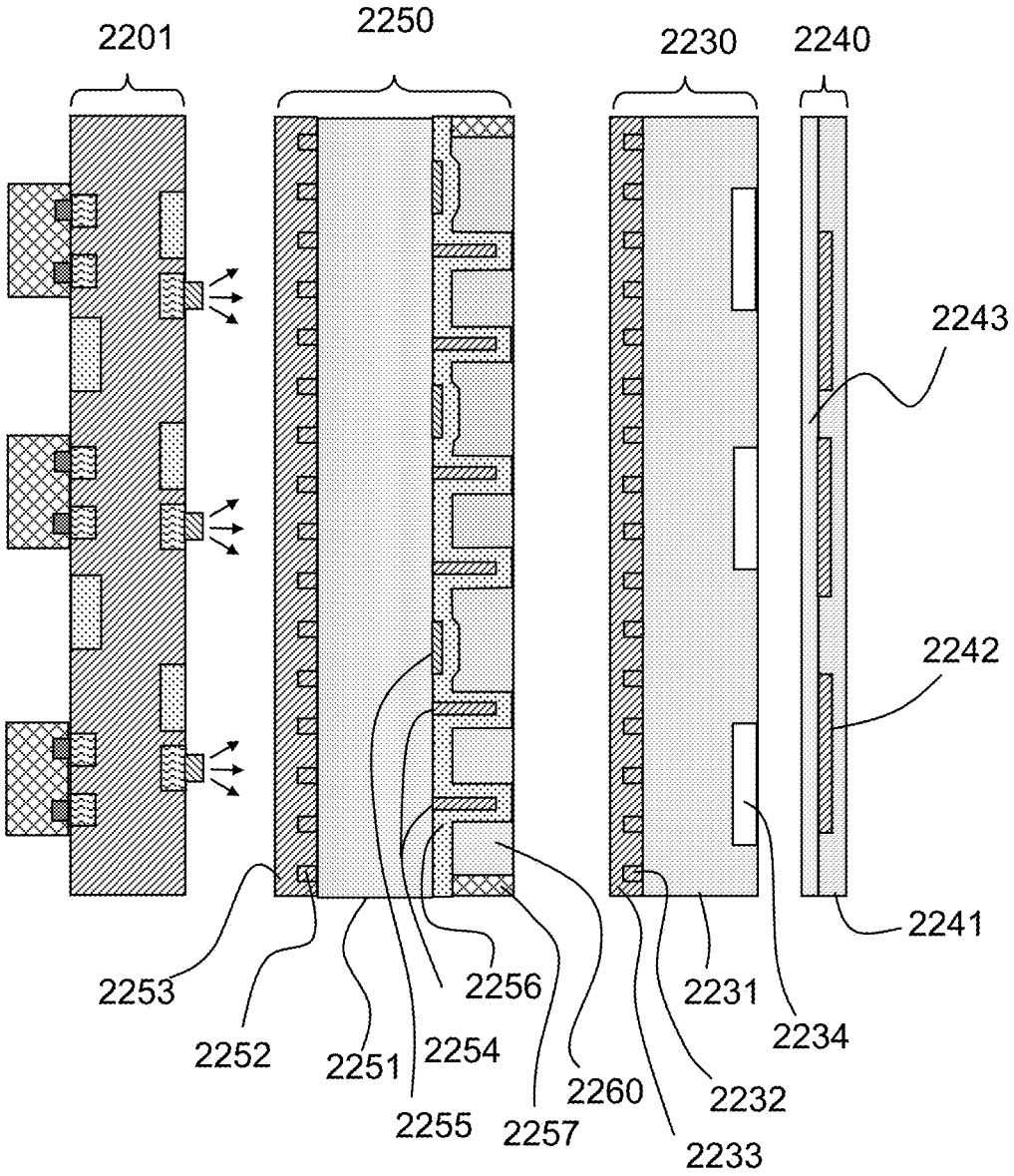

In accordance with the invention, an embodiment of flat panel displaying and sounding system is illustratively presented in FIG. 22B, which is based on in-plane switching LCD display, thin layer of subwavelength optical polarizer, and combined panel of LED matrix and sound driver array. The embodiment comprises, from left side to right side of the drawing, combined panel 2201 having LED matrix and sound driver array as illustrated in FIG. 21, control panel 2250, liquid crystal layer 2260, cover panel 2230 and sound generating integration layer 2240. Liquid crystal layer 2260 is only present when liquid crystal is filled during assembling. Panel 2230 and layer 2240 have been described in immediate above paragraph. Control panel 2250 one side of substrate 2251 fabricated with metal grating wires 2252 acting as subwavelength optical polarizer and a passivation layer 2253 on top to protect the wires, and, the other side of substrate 2251 fabricated with in-plane switching pixel cell layer. The in-plane switching pixel cell layer forms a cell for each pixel in which liquid crystal (LC) is later filled in. Each pixel cell contains control circuit 2255 made of TFT for addressing and in-plane switching electrodes 2254 connected to the control circuit, wherein electrical field parallel to substrate plane is established and controlled for in-plane LC manipulation by electrical potential difference between electrodes 2254. Passivation layer 2256 is deposited on control circuit 2255 and electrodes 2254 for insulation. Spacers 2257 are made using similar thin film processing on the substrate as well. During assembling, spacers 2275 hold panel 2250 and panel 2230 in place for filling LC in. For assembling, panel 2201, panel 2250, panel 2230 and layer 2240 are manufactured separately and attached together to form a flat panel system. A preferred assembling sequence is as following: attaching panel 2250 to panel 2230; filling in liquid crystal 2260 into intermediate space of the assembly; attaching layer 2240 onto the assembly; and, attaching panel 2201 to complete the assembly.

In accordance with merits of teaching, an OLED lighting layer, which is an OLED structured layer for lighting or illumination, can be used for the backlight layer of above embodiments of the flat panel displaying and sounding system based on LCD type display. LED matrix in the above embodiments, if applicable, can be replaced with an OLED lighting layer to attain equivalent function. Using OLED lighting layer in these embodiments accordingly are viewed within the scope of the embodiments in accordance with the invention.

Figure 23A:
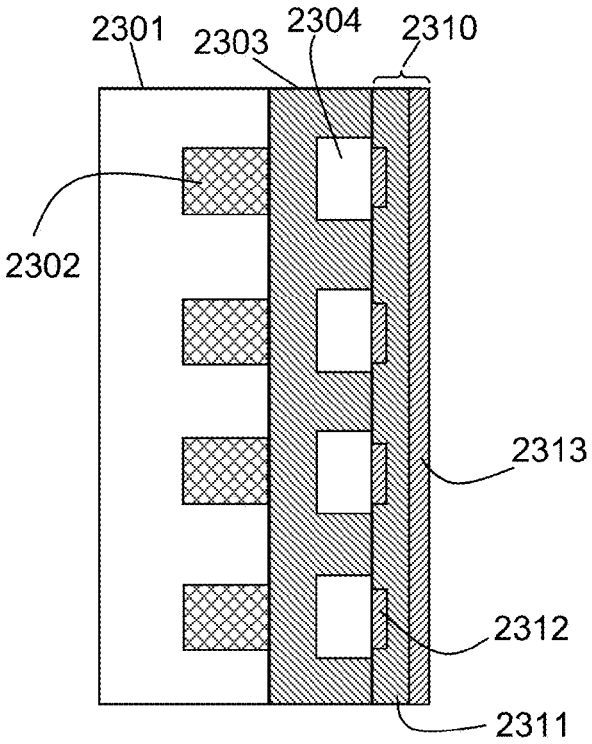
FIGS. 23A and 23B illustratively show some embodiments of flat panel displaying and sounding system based on OLED display, in accordance with the invention.

In accordance with the invention, an embodiment of the flat panel displaying and sounding system based on flexible OLED type display is illustrated in FIG. 23A. The embodiment comprises sound driver array panel 2301, sound generating OLED layer 2310 and cavity layer 2303 in between. Panel 2301 contains array of sound driver 2302. Cavity layer 2303 has cavities 2304 laterally aiming to the sound drivers.

Figure 23B:
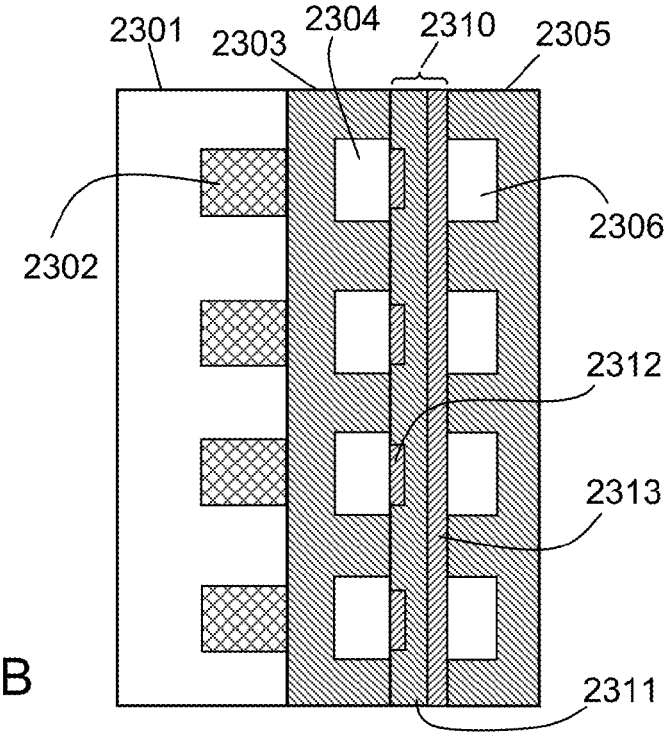

Layer 2310 has a flexible carrier substrate 2311. On substrate 2311, driver response media 2312 is contained on the side adjacent panel 2301. The other side of substrate 2311 has OLED display layer 2313 fabricated upon. Substrate 2311 is flexible, such as PET or the like polymer film, or very thin paper or fabric, or multi layers of the combination of those materials. Driver response media 2312 causes cavity portions of layer 2310 to vibrate under driven by sound drivers 2302. For example, for magnetic field driving means, media 2312 may be made of a thin layer of ferromagnetic material. For electrical field driving means, media 2312 may be a common electrode layer made of conductive material. For ultrasonic wave driving means, media 2312 may be made of a thin layer of ultrasound stopping material. Please refer to other paragraphs in this disclosure for details about driver response media. Media layer may be a continuously deposited layer across substrate 2311. It may also be present only inside cavity areas by selectively depositing to corresponding areas. Media 2312 may be made prior to or after the fabrication of OLED display layer 2313. For assembling, panel 2301 and layer 2310 are made separately, then are attached together with cavity layer 2304 in between. It is preferred that cavity layer 2304 is made on panel 2301 prior to the attachment. The embodiment may further have a cavity layer 2305 covering the other side of layer 2310, as illustrated in FIG. 23B. Cavity layer 2305 has cavities 2306 corresponding to cavities 2304 on layer 2303. Here, encapsulating layer 2310 by layers 2303 and 2305 makes layer 2310 less susceptible to moisture and oxygen in the air, thus extending lifetime of OLED display. To further improve OLED lifetime, cavities 2304 and 2306 may be filled with inert gas or liquid. For the case of filling gas or liquid, cavity 2304 may be channeled with corresponding cavity 2306 by having fluidic passage through layer 2310. The embodiment is best suitable for advertisement display in public places to set forth audio advertising in directional sound waves, which is to be discussed in detail in later following paragraphs, thus minimizing uncomfortable disturbance to others.

Now, in accordance with the invention, we will discuss how to control the flat panel displaying and sounding system. For the system, control of the flat panel displaying layer is the same as controls of flat panel display. The knowledge of controls of flat panel display is readily available in many publications and possessed by ordinary skilled artisan in field of display. Teaching on control of the flat panel displaying layer is not necessitated for this disclosure. So, we will focus on how to control the flat panel sounding unit array (also referred in short as sounding panel). The challenges of controlling the sounding panel come from two aspects: optimal acoustic frequency limitation of sounding unit and vast numbers of sounding units.

Figure 24A:
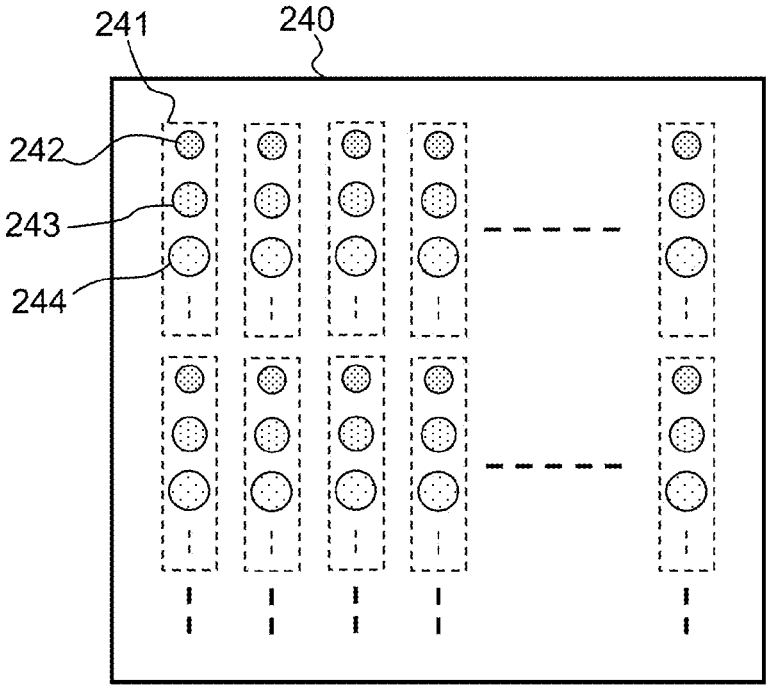
FIG. 24A, 24B, 24C and 24D are illustrative showings of a variety of grouping configurations of sounding unit array.
Figure 24B:
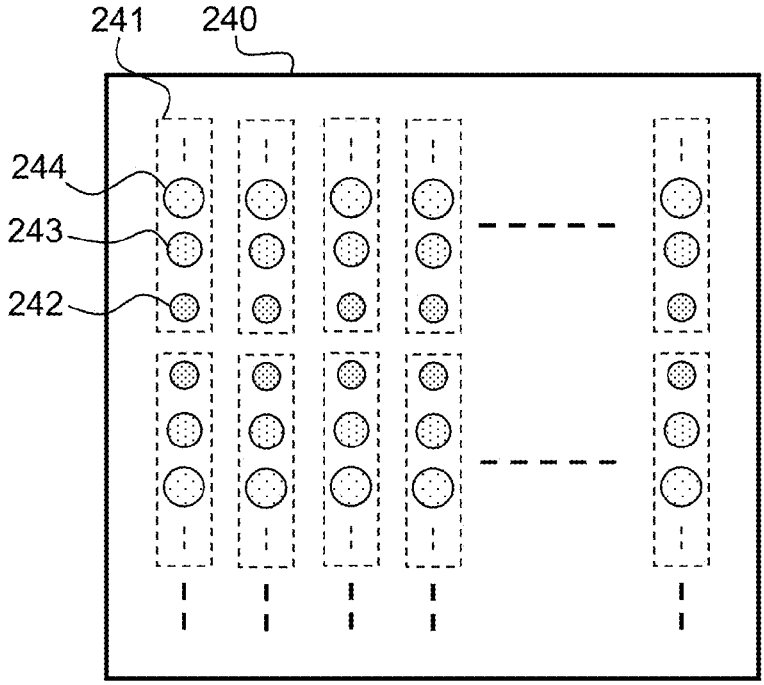
Figure 24C:
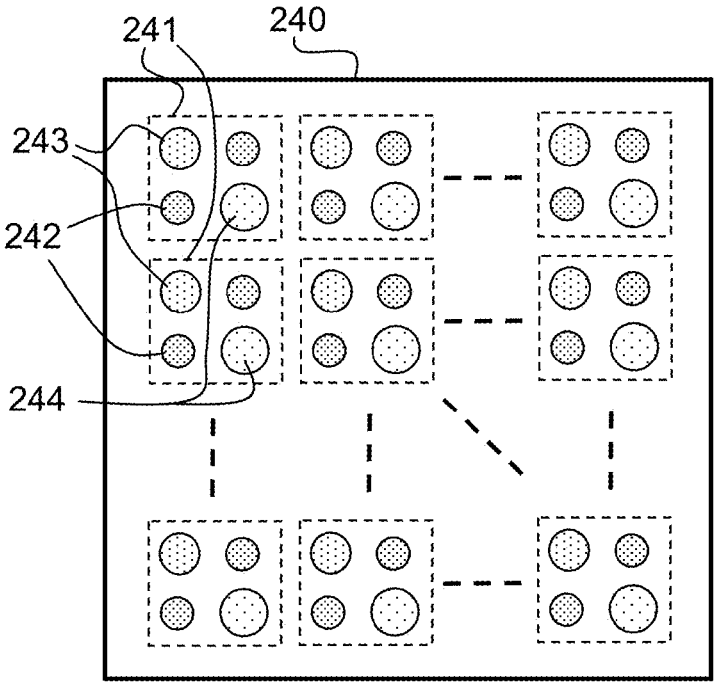
Figure 24D:
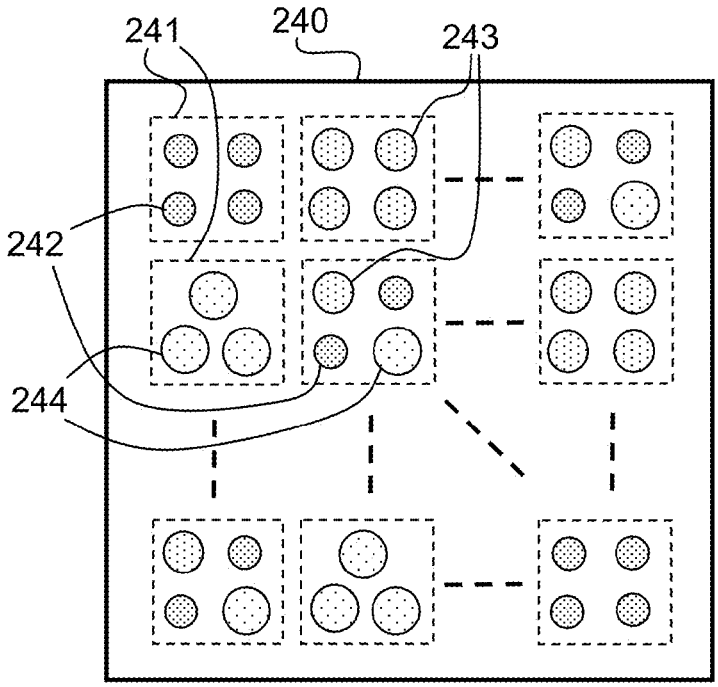

Because acoustic characteristics of each sound unit is often determined by physical dimensions, each sounding unit always has an optimal sounding frequency range. It is not likely to design one sounding unit to have very broad sounding frequency range meeting all aspects of sounding needs. Therefore, sounding units should contain a variety of designs, each covering a certain range of sounding frequency, and, collectively covering desired range of sounding frequency. FIG. 24A to 24D illustratively show some configurations to arrange sounding units into groups, each group having a collection of sounding unit for intended group sounding performance. As shown in FIG. 24A, top view of sounding panel 240 has sounding units, represented by circles in the drawing, arranged into an array of sounding groups 241. Each sounding groups 241 consists of several sounding units 242, 243, 244 and so on having different ranges of optimal sounding frequency. In each group, these sounding units is arranged in a line format starting with higher frequency unit 242 from top and following downward with lower frequency unit 243, then 244, and so on. FIG. 24B illustratively shows similar arrangement but having some groups internally arranged as upward from lower frequency unit to higher frequency units. FIG. 24C illustratively shows each group 241 internally having an 2×2 array of sounding units of different ranges of optimal sounding frequencies. The drawing shows, as an example, each group 241 having two high frequency unit 242, one medium frequency unit 243, and one low frequency unit 244. FIG. 24D illustratively shows similar overall grouping arrangement as FIG. 24C, but groups internally having a variety of sets of sounding units. As exemplarily shown in the drawing, one group consists of four high frequency units 242. Another group consists of 2×2 array of four medium frequency units 243. Another group consists of three low frequency units 244 in triangular format. Another group consists of 2×2 array of two high frequency unit 242, one medium frequency unit 243, and one low frequency unit 244. It should be understood that purpose of presenting FIG. 24A to 24D is to teach the way to group sounding units to compliment each other for a broader sounding frequency range or larger sounding power. The exemplary configurations shown in these drawings are for illustration only to teach public how to group sounding units, and do not infer any preference hereby. It should be also understood that actual grouping does not have to place involving sound units adjacent each other. The involving sounding units may be grouped through electrical circuitry either on the panel or outside the panel. Alternatively, it should be understood that there may not be any physical form of grouping presented in the system when grouping is carried on by signal processing and driving signal dispatching in control circuitry. In such scenario, grouping is often realized by hardware logic of control circuitry or program running on the processor of control circuitry. Thus, grouping may be dynamically changed by varying hardware logic setting or by the program.

Figure 25:
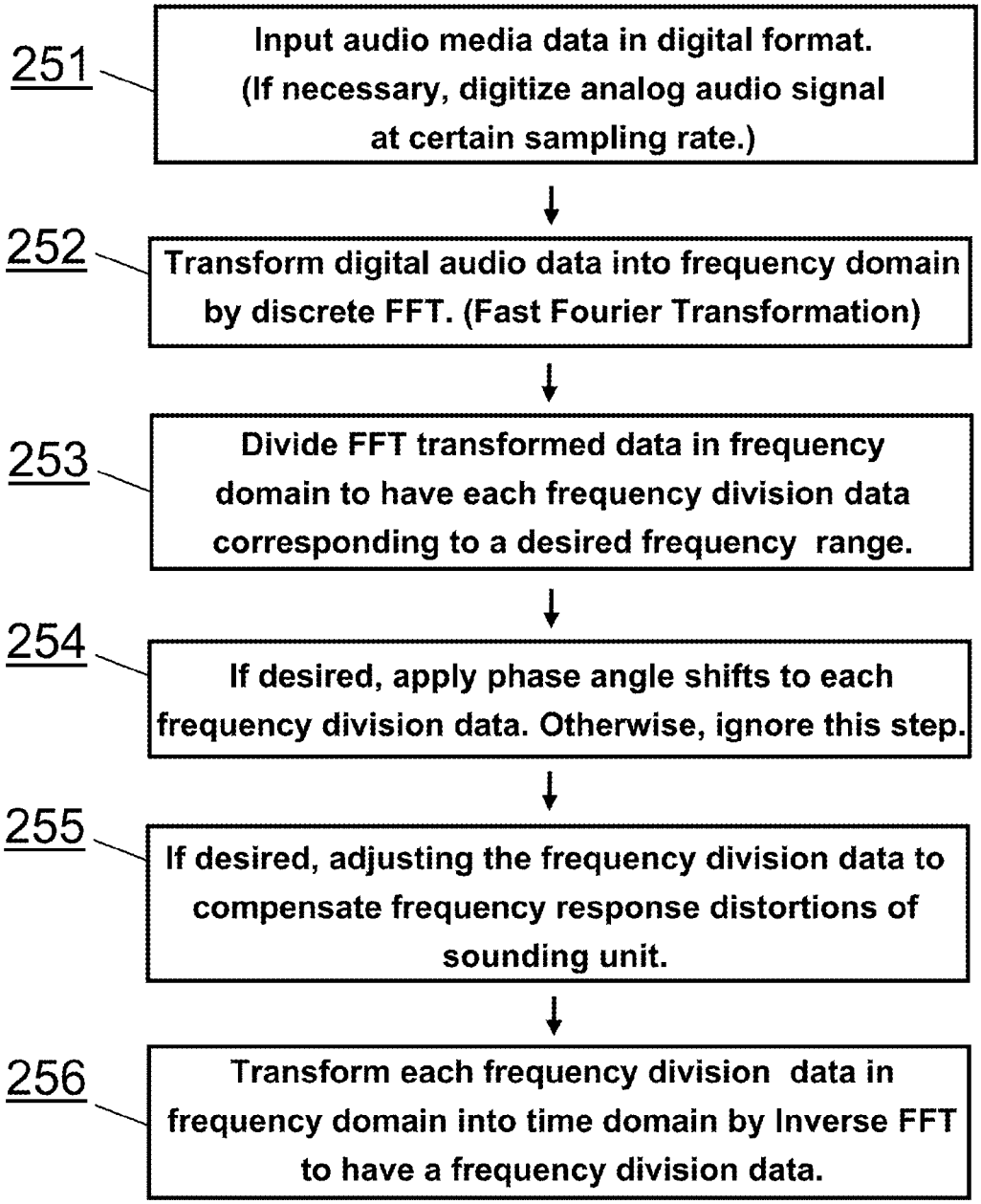
FIG. 25 illustratively gives a general procedure to process input audio data to have frequency division data corresponding to desired frequency ranges and have phase shifts implicated if applicable.

Because sounding units may have a variety of limited optimal frequency ranges, audio media data or signal often covers a broader frequency range. For better performance or best harnessing sounding potentials of the sounding panel, each sounding unit should be driven by specific signal of a desired frequency range. Therefore, coming-in audio media data or signal should be divided according to the desired frequency ranges to get frequency division driving signal optimized for each desired frequency range. Then, the frequency division driving signal is sent to drive sounding units corresponding to the frequency range. FIG. 25 illustratively gives a general procedure of signal processing to divide audio data into a plurality of frequency division data according to desired frequency ranges. According to the drawing, the procedure starts with digital audio media date received from audio media source, as shown in block 251. If coming-in audio signal is in analog format, the signal should be digitized by sampling the analog signal to convert analog data to digital data at a certain sampling rate. Digital format of audio data is represented by a stream of digital bits data with a time interval between adjacent data. The time interval is typically represented by sampling rate, sampling frequency or the like. The number of bits of each data is often called bit depth. Audio media often comes with multi channels of audio data. For example, CD audio disc has audio media stored in 44.1 kHz/16 bits/2 (stereo sound). DVD audio media has a variety of digital formats, such as 96 kHz/16 bits/5.1 (full surround). Each channel of audio media should be processed individually since multi channels often relate to spatial effect of sound.

How to achieve spatial sounding effect for the sounding panel will be discussed later in the disclosure. In following step shown in block 252, the digital audio date is transformed into frequency domain by discrete Fast Fourier Transformation (FFT). Then, in following step as shown in block 253, the FFT transformed data is divided according to desired frequency ranges to have a plurality of groups of data. Each group of data is the frequency division data corresponding to a desired frequency range. After that, in next step as shown in block 254 if desired, phase angle shifts may be applied to the frequency division data. Different phase shifts may be applied to the same frequency division data, resulting different derived frequency division data embodying different phase shifts. Each phase shift derived frequency division data is proceeded to following steps of the procedure to get its corresponding driving signal. The phase shift data processing is used to create driving signals to drive various sounding units of the same frequency range but having various locations on the sounding panel, for the purpose to interferingly produce a directional beam of sound waves in the frequency range. In following step as shown in block 255, the frequency division data may be adjusted to compensate frequency response distortions of sounding units. The sounding unit may not response in the exact same manner for various frequencies in the frequency range, causing output sounds distorted from driving signal. This distortion can be characterized in experiments, then, the experimental characterization can be used to correct the frequency response distortions. Depending on necessity, this step may be ignored to continue. Next step, as shown in block 256, is to transform each frequency division data in frequency domain into time domain by inverse FFT (Fast Fourier Transformation). Thus, frequency division data corresponding to the frequency range used for the division is obtained. Performing inverse FFT for all frequency division data in frequency domain results a collection of frequency division data corresponding to desired frequency ranges and a variety of desired phase shifts if applicable. Since sounding unit is driven by analog driving signal, the frequency division data in digital form are eventually converted to analog signals by DACs (Digital Analog Converter) to drive the sounding panel.

The sounding panel may contain a vast number of sounding units, which may be far beyond number of speakers possessed by, and, number of audio channels playable by conventional sounding system. For example, a 10 by 10 array of sounding units has 100 units, a 50 by 40 array has 2000 units, a 100 by 50 array totals 5000 units, and a 200 by 100 array reaches stunting number of 20000 units. Traditional audio driving circuitry is no longer capable of handling such large number of units. Thus, it demands finding new schemes to electrically drive such many sounding units.

Figure 26:
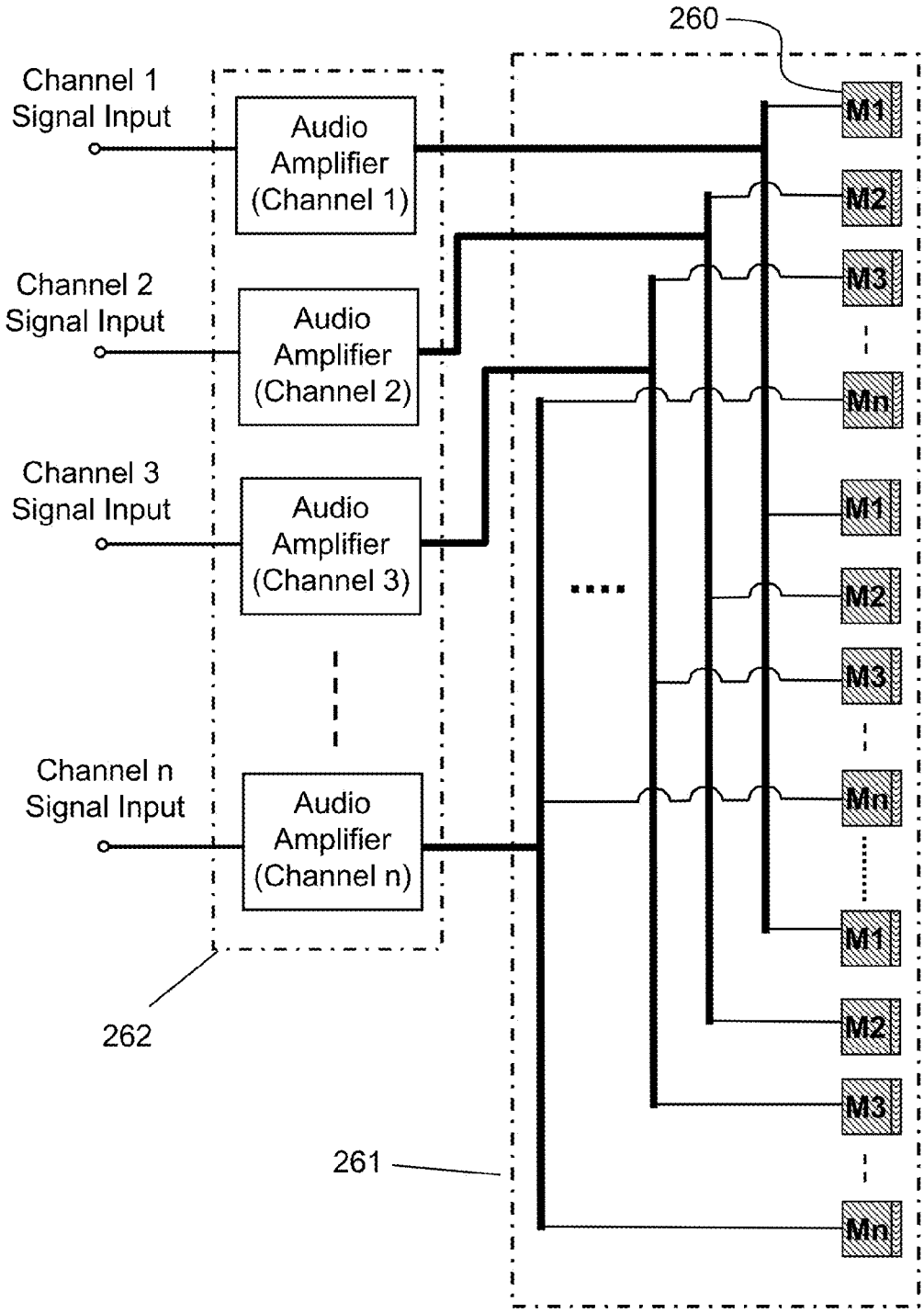
FIG. 26 is an illustration of a driving scheme to drive flat panel sounding unit array, useful for flat panel displaying and sounding system in accordance with the invention.

One scheme to drive the sounding panel is illustratively shown in FIG. 26. In the drawing, dot-dash lined rectangle 261 represents sounding panel, enclosing all sounding units 260. The sounding units are divided into groups. The number of sounding units in a group may be any from one to total number of sounding units on the sounding panel. For convenience of illustration, each group is shown to have equal number of sounding units and identical configuration of sounding units regarding to optimal range of sounding frequency. It is obvious for ordinary artisan to comprehend concept and spirit of this teaching and modify the teaching accordingly for various grouping scenarios. In the drawing, each group has sounding units ranged from M1 to Mn. Each sounding unit such as M1 is connected corresponding sounding units such as M1 of other groups. Then, they are all connected to a common input. The common inputs are connected to channel signal inputs, which send in driving signals of channels. As shown in the drawing, all M1 units of the groups are connected to channel 1 signal input. All M2 units of the groups are connected to channel 2 signal input. And so on, all Mn units of the groups are connected to channel n signal input. Audio amplifier to amplify input signal may be present from channel signal input to corresponding common input of sounding unit set, as shown in the drawing. These audio amplifiers may be physically presented on a PCB board or in a IC chip represented by dot-dash lined frame 262. The PCB or Chip is either attached to periphery of the sounding panel or placed elsewhere in the system and electrically connected to common inputs on the sounding panel. The scheme drives all sounding units by sending in signals through a limited number of signal channels. Driving signal of Each signal channel is best suitable for optimal frequency range of corresponding sounding unit set. Thus, signal of audio media inputted into the system should be divided according to channel frequency ranges. Then divided signal of each frequency range is sent to signal input of corresponding channel. The general procedure to do the frequency division is described in above paragraph and illustratively given in FIG. 25. The FFT division procedure is performed by either a signal processing chip or a general CPU type processor running program for the same purpose.

Figure 27A:
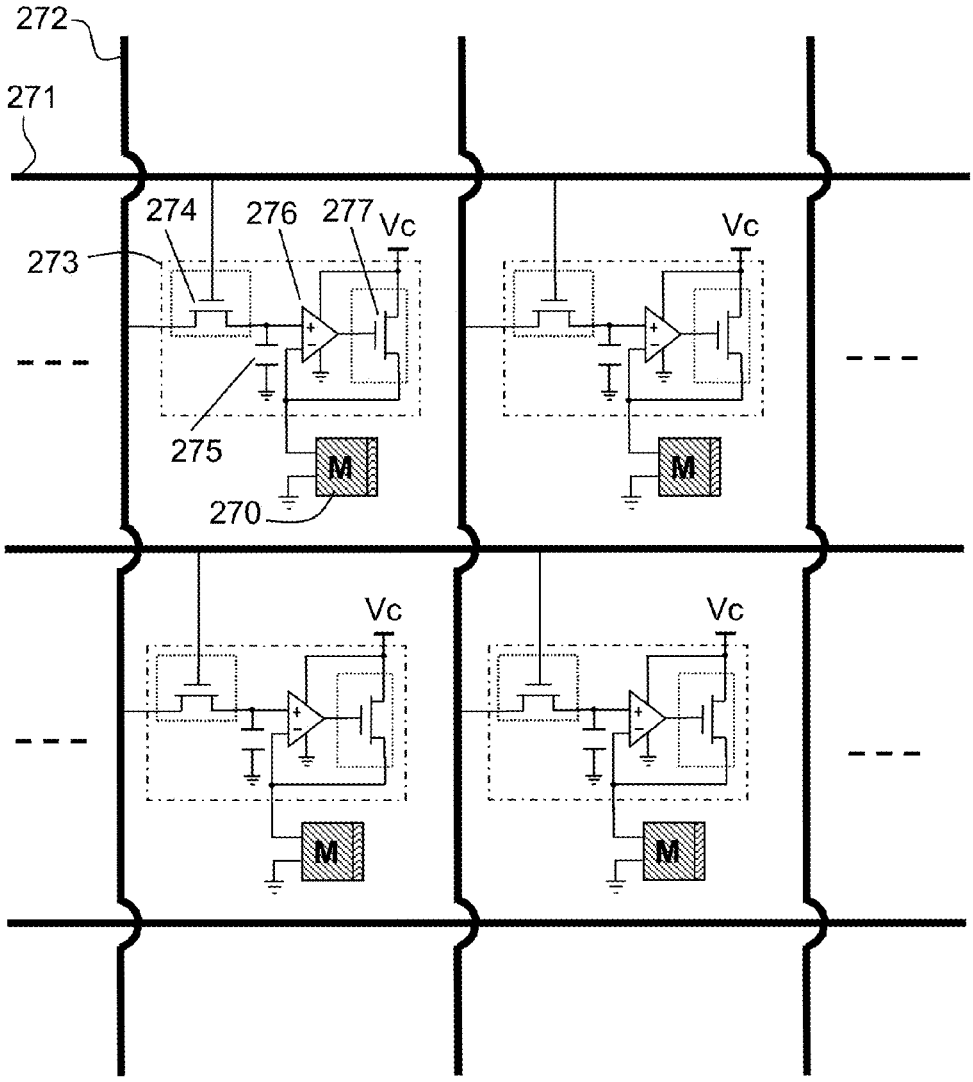
FIGS. 27A and 27B illustratively give active matrix driving schemes to drive flat panel sounding unit array, useful for flat panel displaying and sounding system in accordance with the invention.
Figure 27B:
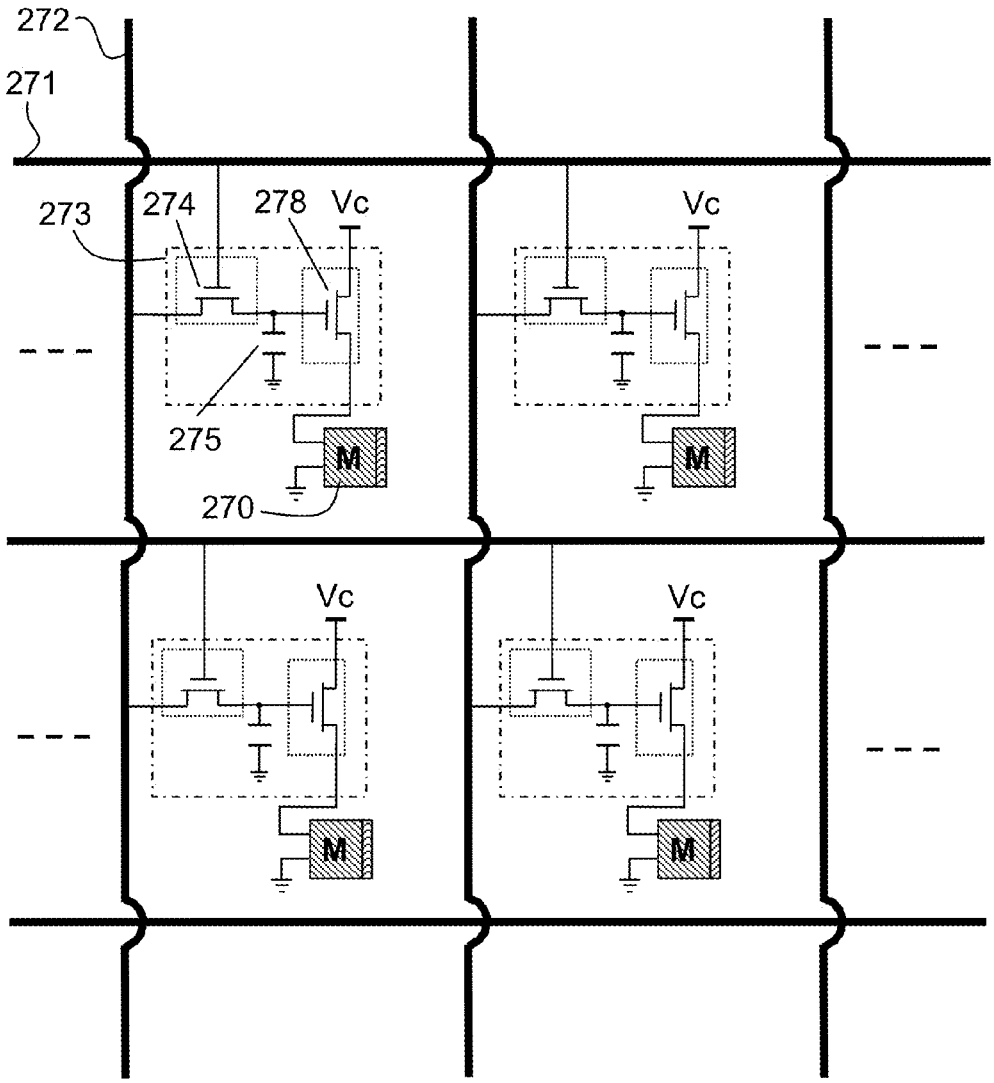

An active matrix driving scheme to drive the sounding panel is illustratively presented in FIGS. 27A and 27B. The active matrix driving scheme is generally similar to active matrix pixel addressing of flat panel display such as active matrix LCD. Comparing to control a display pixel, either much higher voltage or much larger current load is demanded to drive a sounding unit. Thus, unit driving circuitry of the active matrix driving scheme should be able to deliver needed high voltage or large current.

FIG. 27A illustratively presents the active matrix driving scheme with an embodiment of unit driving circuitry. According to the drawing, the active matrix driving scheme has row lines 271 and column lines 272 crossed at locations of sounding units 270. Here, row lines 271 acts addressing and column lines 272 acts driving. No matter what type of sounding unit to drive, voltage signal transmitted by column lines is low voltage comparable to general voltages presented in IC chip circuitry or display matrix addressing such as TTL. The voltage signal will not drive sounding unit directly. Instead, it controls a unit driving circuitry 273 to drive its corresponding unit powered by common voltage supply Vc, which provides needed voltage or current. Unit driving circuitry 273 comprises an addressing FET (field effect transistor) 274, a storage capacitor 275, an operational amplifier 276 and a driving FET 277. Control gate of FET 274 is connected to corresponding addressing row line 271. Conductional channel of FET 274 has one end connected to corresponding driving column line 272 and the other end connected to input end of storage capacitor 275. The other end of capacitor 275 is connected to electric ground. Positive input of operational amplifier 276 is connected to the input end of capacitor 275 as well. Output of operational amplifier 276 is connected to control gate of FET 277. Conductional channel of FET 277 has source end connected to common voltage supply Vc, and, drain end connected to both driving input of corresponding sounding unit 270 and negative input of operational amplifier 276. The operational amplifier may receive its own power supply from above common voltage supply Vc (as shown) or another common voltage supply specifically for the need (not as shown). When the row line is addressed, it turns on FET 274. The voltage of driving signal sent in by the column line is conducted to input end of capacitor 275. Before addressing goes to next row line, The voltage of driving signal is stored in capacitor 275. Then, next row line is addressed and corresponding capacitor is charged to voltage of driving signal for corresponding unit. Above step is repeated until all row lines are addressed. After that, a new cycle of row line addressing starts. Before next addressing occurs to the row line, storage capacitor 275 retains the stored voltage until it is refreshed during next addressing. In order to retaining the voltage for a certain period, corresponding sounding unit should not be driven directly by the capacitor voltage, which would drain out quickly. According to the drawing, sounding unit 270 is powered by electric current through conductional channel of FET 277, which in turn is supplied by common voltage supply Vc. A negative feed-back loop is formed between two inputs of operational amplifier 276, which starts from positive input of amplifier 276, then, output of amplifier 276, then, control gate of FET 277, then, current downward end of conductional channel of FET 277, to negative input of amplifier 276. The negative feed-back loop constantly attains almost the same voltage for both inputs of operational amplifier, which is in turn applied upon sounding unit 270. Operational amplifier 276 consumes very little current from its positive input for the operation. Therefore, stored voltage on capacitor 275 is almost retained until next refreshing. Sounding unit 270 receives consumed current from common voltage supply Vc. It is reminded that voltage signal sent through column line is synchronized with row line addressing to be sure that, when a row line is addressed, voltage signal on column lines are voltages for corresponding units of the row line. Refreshing frequency of driving signal to sounding units should be fast enough to keep audio quality. For example, to have CD audio quality, the refreshing frequency requires 44.1 kHz. To have DVD full surround audio quality, the refreshing frequency requires 96 kHz. The signal updating frequency on column line is equal to the refreshing frequency times number of row lines. For example, if number of row lines is 100, the signal updating frequency is 4.41 MHz for CD audio quality and 9.6 MHz for DVD full surround audio quality. Row scanning frequency is the same as the signal updating frequency.

FIG. 27B illustratively presents the active matrix driving scheme with another embodiment of unit driving circuitry. Comparing with the embodiment illustratively given in FIG. 27A, this embodiment uses a driving FET 278 working at linear region or triode mode (also known as ohmic mode) to control current passing through sounding unit 270. According to the drawing, unit driving circuitry comprise addressing FET (field effect transistor) 274, storage capacitor 275, and driving FET 278. The driving voltage sent in through column line 272 during row line addressing is stored in capacitor 275. The stored voltage is then applied on control gate of FET 278. Because, FET 278 is set to operate in linear region of the FET, electric current passing through conditional channel of the FET is determined in a relation to the control gate voltage. Thus, electric current driving sounding unit 270 is controlled by the stored voltage. We would see that this embodiment of unit driving circuit is best suitable for current driven sounding unit, such as magnetic field type sounding unit or ultrasonic wave type sounding unit.

Figure 28:
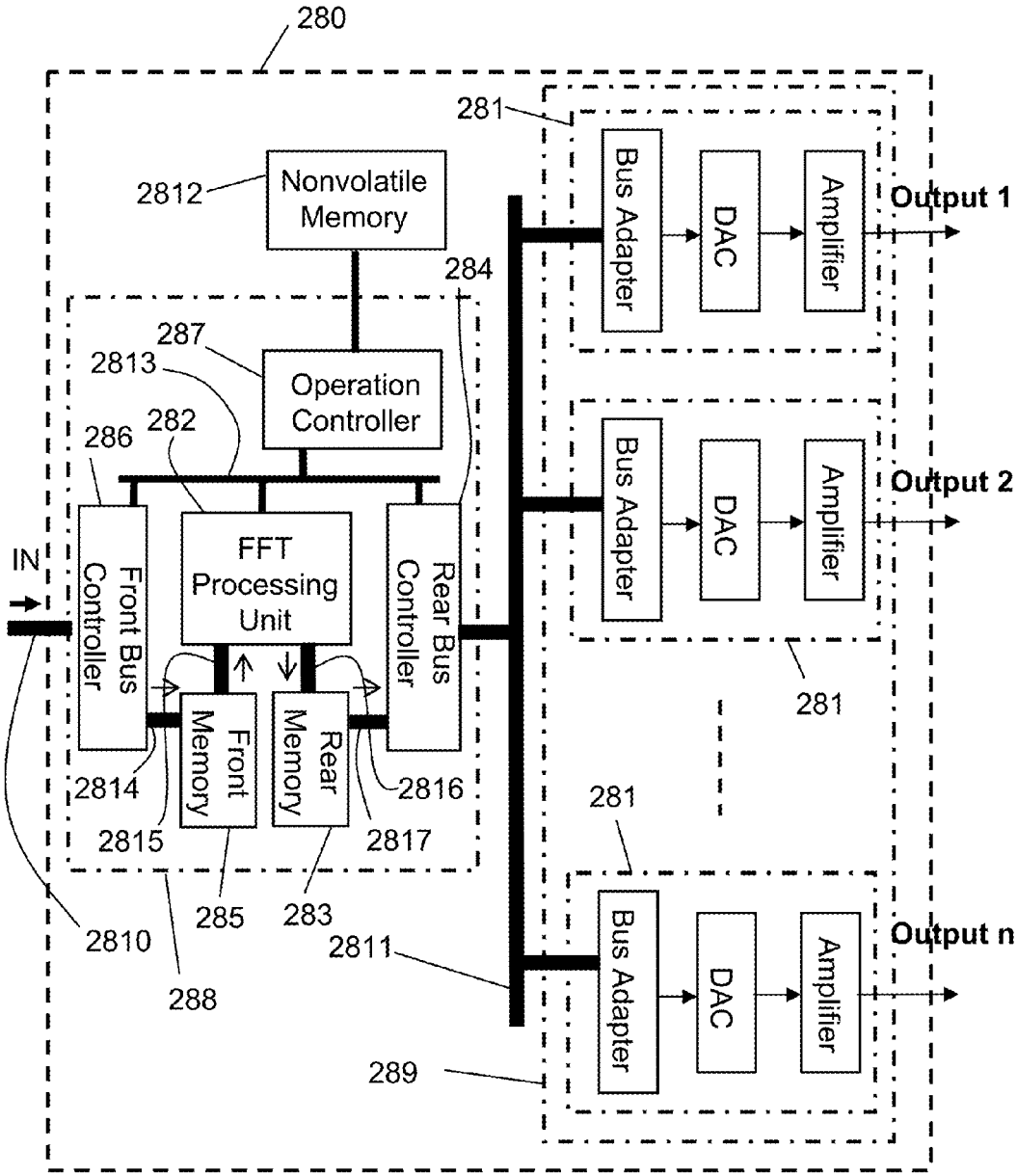
FIG. 28 is an illustrative block diagram of a control circuit performing frequency domain signal division for driving flat panel sounding unit array, useful for flat panel displaying and sounding system in accordance with the invention.

FIG. 28 illustratively presents block diagram of a control circuit using FFT signal processor to drive the sound panel. In accordance with the drawing, control circuit 280 comprises two primitive sections: front circuitry 288 and rear circuitry 289. Front circuitry 288 receives input data of audio media in digital form through front side bus 2810, then, process the data by performing FFT transformation and divide FFT transformed data into frequency ranges desired to drive the sounding panel, after that, form driving data for each frequency range by performing Inverse FFT, finally, dispatch driving data of each frequency range out to rear side bus 2811. Rear circuitry 289 takes the driving data in through rear side bus 2811, then, converts them into analog driving signals with each signal corresponding to one frequency range, finally sends analog driving signals out to corresponding channel inputs of the sounding panel.

Front circuitry 288 includes front bus controller 286, front memory 285, FFT processing unit 282, rear memory 283, rear bus controller 284, operation controller 287 control bus 2813, and data buses 2814, 2815, 2816, 2817 for internal data transfer. Front bus controller 286 receives digital data of audio media through front side bus 2810 and sends the data to front memory 285 through data bus 2814. Data bus 2814 primitively works one way from controller 286 to memory 285 to transfer data. FFT processing unit 282 is an integrated circuit (IC) primitively performing FFT and Inverse FFT to divide data of audio into driving data of desired frequency ranges. Unit 282 may contain caches as buffers to improve operating speed and smoothen pipeline operation. Unit 282 fetches data from front memory 285 through data bus 2815, which works primitively one way from memory 285 to unit 282. Front memory 285 is a data storage IC that has its data storage written through bus 2814 and retrieved through bus 2815. Once data is fetched by unit 282, it is no longer necessary to retain the data. The storage location of the data can be overwritten with incoming data from controller 286. Unit 282 outputs frequency divided driving data to rear memory 283 through data bus 2816. Rear memory 283 stores the driving data and waits for rear bus controller 284 to fetch the data. Rear memory 283 is a data storage IC that has its data storage written through bus 2816 and retrieved through bus 2817. Controller 284 fetches data from rear memory 283 through data bus 2817 and dispatch accordingly to read side bus 2811. Data buses 2816 and 2817 primitively work one way as shown by arrows in the drawing. Because front memory 285 and rear memory 283 have non-conflicted written and retrieval buses, fetching a data from one storage location and writing a data to another storage location may proceed simultaneously. The complete signal processing path of data from coming in to dispatching out can be performed in pipeline seamlessly without glitches. Controller 286, memory 285, unit 282, memory 283 and controller 284 are initially configured and coordinated during pipeline operation by operation controller 287 through control bus 2813. Operation controller 287 is a logic and arithmetic integrated circuit to perform necessary controlling functions. Controller 287 is similar to CPU of computer but much simpler because it only has to have necessary controlling functionality. Operation controller 287 may access a nonvolatile memory 2812 to obtain system settings necessary for initial configuration of control circuitry. Front circuitry 288 may be realized as an IC chip containing the whole circuit of the same. It may also be realized as several IC chips collectively containing the whole circuit of the same.

Rear circuitry 289 is made of a plurality of DAC (digital analog converter) modules 281. Each module 281 comprises a bus adapter and a DAC, and may further comprise an amplifier. The bus adapter communicates with rear bus controller 284 of front circuitry 288 through rear side bus 2811 and only takes data deemed for its containing module in for following DAC conversion. The DAC converts data from the bus adapter into analog signal. Amplifier may be used to increase driving power of output signal. One module 281 is set to receive driving data of one frequency range for conversion and output corresponding analog signal. The drawing shows total n outputs from the control circuit. Rear circuitry 289 may be realized by using a plurality of IC chips, each chip embodying circuit of module 281. Or it may be embodied into a single IC chip.

In regarding to make control circuit 280, one way is to have all related chips installed on a PCB board like computer motherboard. The PCB board has all buses and accessory components already made on. Another way to make control circuit 280 is to bond a chip of FFT signal processor embodying front circuitry 288 with a rear circuitry chip directly to form one chip assembly. If rear circuitry 289 depends on several DAC module chips to cover intended number of outputs, above chip bonding may be performed by bonding all related chips onto a carrier chip, which is large enough to accommodate the chips and comprises interconnects to link the chips.

To drive the sounding panel with the driving scheme illustratively shown in FIG. 26, control circuit 280 should have the same number of outputs as the channel inputs presented on the sounding panel. To drive the sounding panel with the active matrix driving scheme illustratively shown in FIGS. 27A and 27B, control circuit 280 should have the same number of outputs as the column lines presented on the sounding panel. For this purpose, rear bus controller 284 of the control circuit should fetch data of driving sounding units belonging to the same column line, assort and interlace the data according to scanning sequence of their belonging row lines, then, dispatch the data to DAC module 281 correspondingly outputted to a column line. During active matrix driving, the timing of column signal is synchronized with row line scanning to ensure each sounding unit receiving correct driving signal.

Now we are going to discuss several scenarios to use fat panel displaying and sounding system in accordance with the invention.

Figure 29:
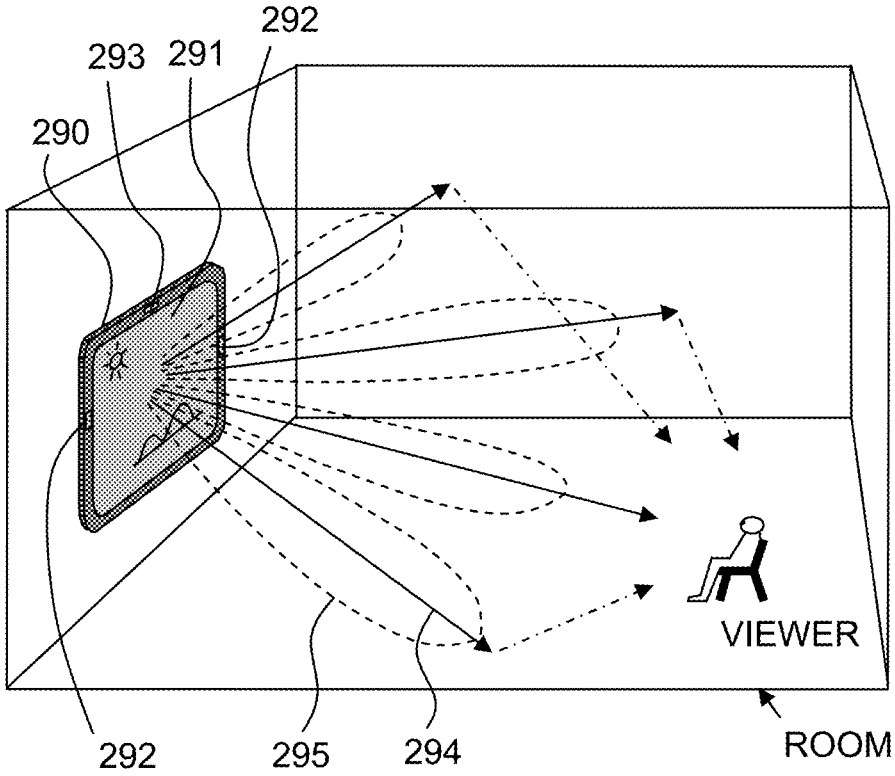
FIG. 29 illustratively shows a scenario to use flat panel displaying and sounding system in accordance with the invention, to realize surround sound effect.

One scenario is to create surround sounding effect by forming directional sound wave beams. As illustratively shown in FIG. 29, inside a room, a viewer is seeing pictures displayed on front surface 291 of flat panel displaying and sounding system 290. Flat panel system 290 is standing against or hung on one side of wall opposing the viewer. System 290 generates a variety of sound wave beams 295 along various directions 294. Some beams are not pointed toward viewer directly, but pointed towards side walls, ceiling or floor. The sound waves of the beams reach the viewer after being reflected. Thus, surround sound effect can be realized by the system. For example, to achieve 5.1 surround sound effect, one sound beam goes directly to viewer for center soundtrack. Two sound beams go toward nearer portions of left and right side walls to be reflected to viewer for left and right soundtracks. Two sound beams go toward farther portions of left and right side walls or the side wall behind viewer to be reflected to viewer for surrounding soundtracks. Low frequency soundtrack may be played by a subwoofer attached separately or contained in enclosure body of the system. In order to deliver best sounding effect, the system may contain a digital camera 293 in the panel enclosure frame region to detect location of viewer. Corresponding image processing and recognition are needed to decide location of viewer. So, the system may adjust generated sound beams accordingly and get better surround sound effect at viewer's location. The system may further contain a set of microphones 292 embedded into frame region and spaced apart for a self-calibration to determine room context. The self calibration is, in general, performed by forming one or several narrow sound beams and steering the beams to scan the room, then, analyzing received signals from the set of microphones to determine setting parameters of room context. This illustration is just to facilitate comprehension of potential applications of the system. The full potential of the system is far beyond what the illustration shows. Because the flat panel system can generate many directional sound beams and display surface related sound beam, it is potentially capable of providing much richer 3-D sounding effect closely correlating to displaying pictures, thus rendering unprecedented multimedia user experience.

Figure 30:
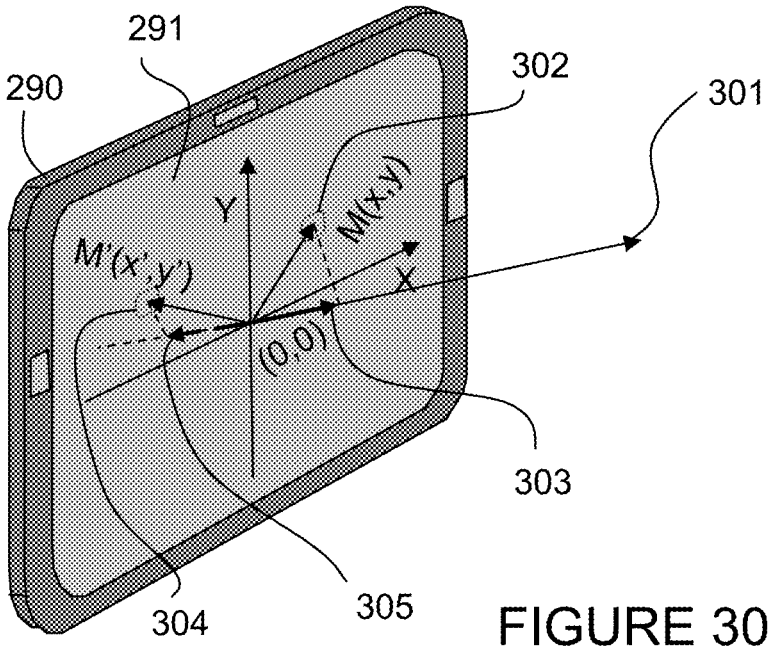
FIG. 30 exemplarily shows basic principle of forming directional sound wave by flat panel displaying and sounding system in accordance with the invention.

Generally, directional sound beam is generated based on adjusting phase shifts of a plurality of sounding units. The phase shift theory and related methods for forming directional wave have been well established in physics. The fundamental idea forming direction sound beam is to keep sounding waves generated by all involved sounding units in phase along desired direction. Phase shifting of driving signal is accomplished during the FFT transformation procedure illustratively given in FIG. 25. A very simple scenario illustratively shown in FIG. 30 shows basic phase shift principle. In the drawing, assuming a sound beam along direction 301 to be constructed, a plurality of sounding units of system 290 are driven with the same driving signal corresponding to the sound beam but having different phase shifts. How much phase shift is needed depends on position of the sounding unit in sounding unit array. Two sounding units 302 and 304 are presented in the drawing for exemplary showing. Assume reference point is the center of the array, unit 302 is located at coordinates M(x,y) and unit 304 is located at coordinates M'(x', y'). Project coordinate vectors, which are from center to above locations, along direction 301 to get component vectors 303 and 305 respectively. Phase shift for location M is determined by amplitude of vector 303 divided by sound wavelength. Because vector 303 is positively along direction 301, the phase shift is a delayed value or negative value. Similar calculation is used to determine phase shift of location M'. Because vector 305 is negatively along direction 301, the phase shift is an advanced value or positive value. During sound wave generation, sound waves from unit M and unit M' are exactly in phase, thus constructively interfering each other along direction 301.

Figure 31:
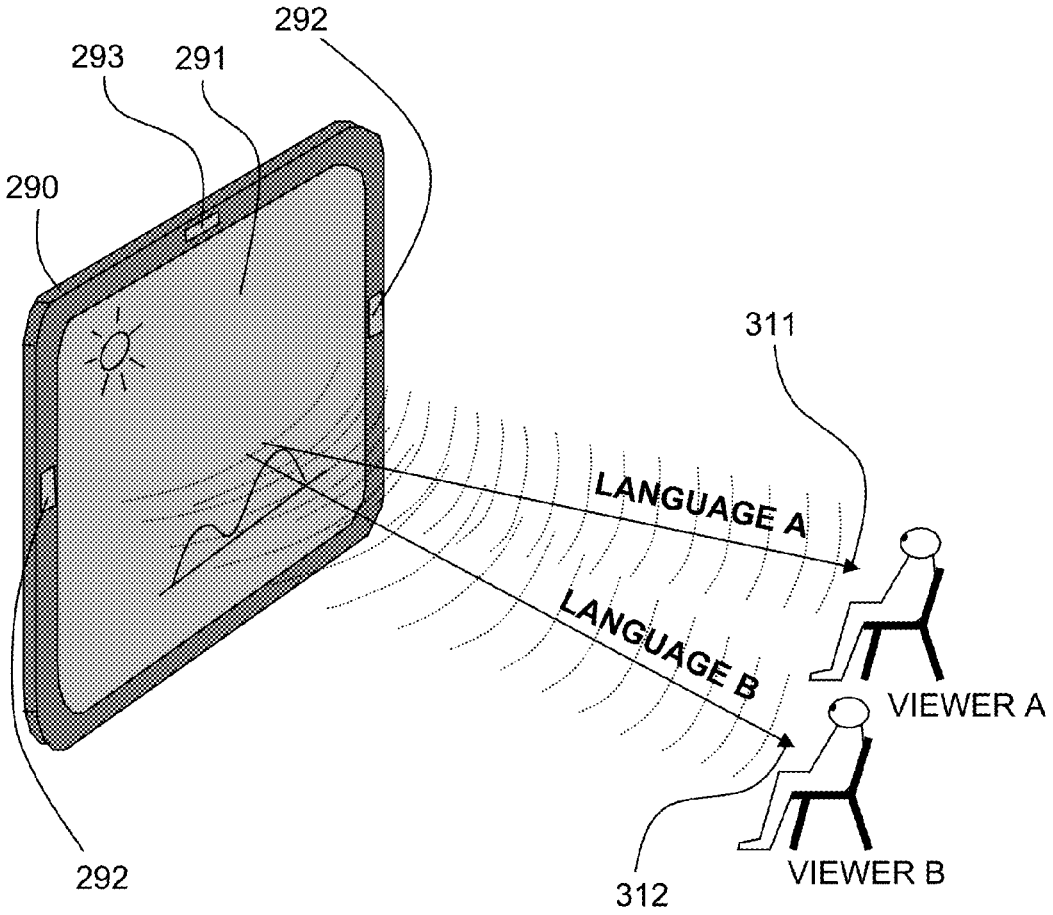
FIG. 31 illustratively shows a scenario to use flat panel displaying and sounding system in accordance with the invention, to selectively deliver multi languages audios to multi viewers without interfering each other.

Another scenario is to create multi language sound wave beams for multi viewers without interfering each other. As illustratively shown in FIG. 31, system 290 emanates two directional sound beams 311 and 312. In the drawing, language A sound carried by sound beam 311 is specifically delivered to viewer A. Language B sound carried by sound beam 312 is for viewer B to hear. If two viewers are seated apart far enough, they won't hear sound of the other language. Thus, two viewers can watch a movie playing on the system together, but choose their own preferred languages to hear without interfering each other. Of course, other soundtracks may be concurrently played as well and shared by both viewer. This scenario is also useful for viewer or viewers to hear sounds without wearing headphone while not annoying others nearby. Using directional sound beam can also concentrate output sounding power along useful or intended direction, thus saving energy and reducing noise pollution to others or environment.

Above two scenarios illustratively show applications of forming directional sound beams by the system. In following two scenarios, we will give exemplary applications of forming display surface related sound beam by the system. One scenario is to create displaying object related sounding effect in accordance with illustratively showing of FIG. 32. The other scenario is to create moving object related sounding effect in accordance with illustratively showing of FIG. 33.

Figure 32:
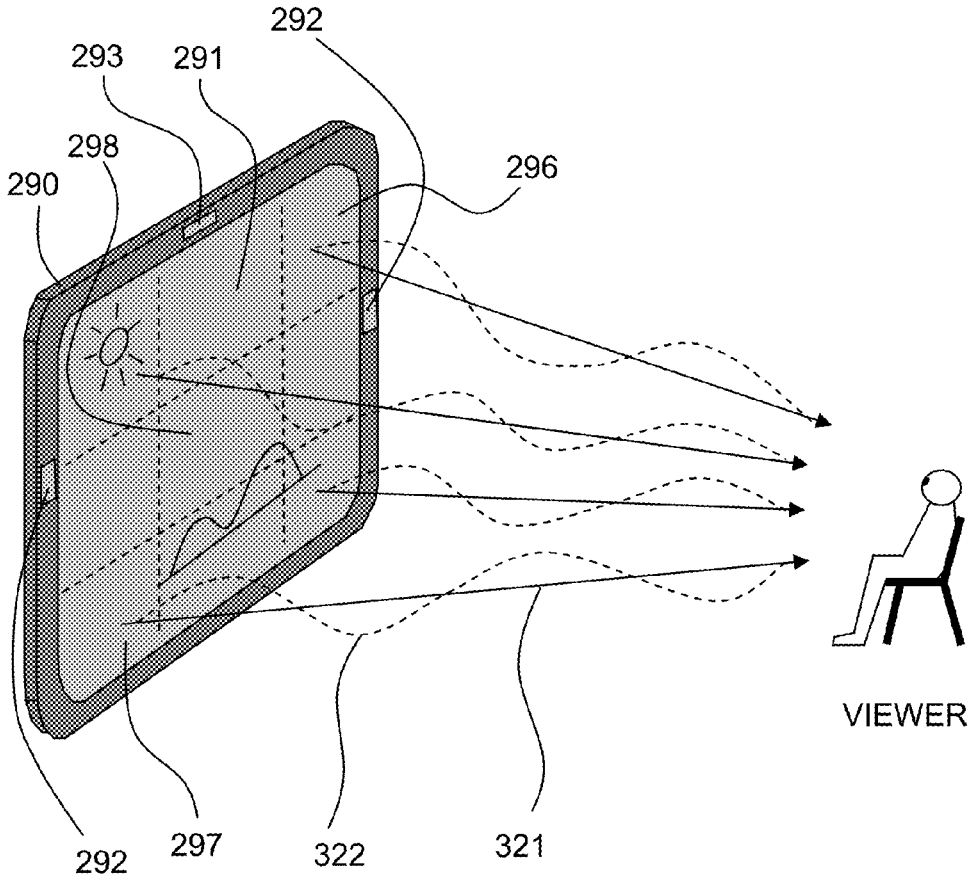
FIG. 32 illustratively shows a scenario to use flat panel displaying and sounding system in accordance with the invention, to generate picture area correlated soundtrack audios.

In accordance with illustration of FIG. 32, panel display surface of system 290 are divided into a plurality of regions. Accordingly, sounding units of the sounding unit array of the system are divided into subsets laterally located within these regions, and, displaying picture is divided into picture portions fallen within these regions. So, each surface region 291 corresponds to a sounding unit subset and a picture portion, which spatially correlate each other. When sounds generated by one sounding unit subset is timely correlated to content or objects shown in one picture portion, displaying object related sounding effect can be realized. It makes viewer feel the sounds coming from the objects displayed. The effect becomes more sensible when panel size is larger or viewer is closer to the panel. As shown in the drawing, panel surface 291 are divided into nine regions such as center region 298, upper-right region 296, lower-left region 297 and other regions. Sounding waves 322 are emanated from these regions along line-of-sight directions 321 toward viewer. It is to be understood that each sounding unit subset can work in similar way as the array of the system. It can create directional sound beam pointing toward viewer or elsewhere to form surround effect. It can also create forward sound beam as broad as covering substantially forward hemisphere, in which no phase correlation control is necessary among involved sounding units. Furthermore, It is to be understood that The subset dividing may be fulfilled either through driving circuit division or through driving signal division using signal processing technique. Later approach of driving signal division does not have any hardware dividing in driving circuit, and, is preferred because the subset dividing may be easily revised or dynamically reconfigured by changing setting parameters of signal processing procedure. Thus, it is advantageous on fully harnessing potential of the system and offering new functionality through firmware upgrade.

Figure 33:
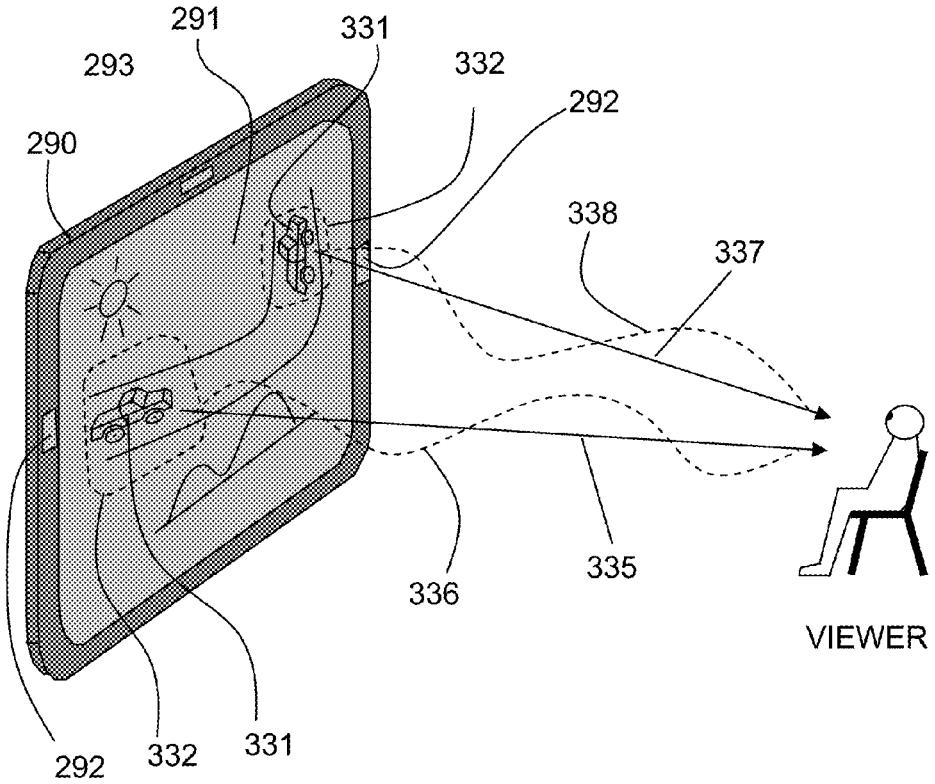
FIG. 33 illustratively shows a scenario to use the flat panel displaying and sounding system in accordance with the invention, to generate moving object correlated soundtrack audios.

As illustratively shown in FIG. 33, moving object related sounding effect is created when sounds come out from momentary region corresponding to current location of the moving object. In the showing of the drawing, pictures displaying on panel surface 291 shows a vehicle 331 moving along road. A surface region 331 representing sound making of vehicle 331 is shown as an area surrounding the vehicle. Region 331 moves in together with vehicle 331 and its shape or area may change accordingly for optimally representing sound making of the moving object. At a first moment, vehicle 331 is located on left side of the panel surface. At a later second moment, vehicle 331 moves to upper right of the panel surface. At the first moment, sound waves 336, representing what the vehicle makes at the moment, come from surface region 331 along direction 335. At the second moment, sound waves 338, representing what the vehicle makes at the moment, come from surface region 331 along direction 337. To implement the scenario, a separate soundtrack representing the moving object is provided in input audio data. The soundtrack data is dynamically encoded into driving data of sounding units corresponding to dynamic region 331. The implementation is fulfilled during signal processing procedure to get driving data for sounding units. Sounding units or array will not discriminate whether received driving data contains the soundtrack data. The implementation is similar to approach of driving signal division described in above scenario illustratively shown in FIG. 32, but having that performed with dynamically varying location and scope of divided region.

The above scenarios illustratively shown in FIGS. 29, 31, 32, and 33 should be comprehended as broadly as possible in accordance with principles or concepts explicitly or implicitly embodied in the illustrative teachings. It should be understood that these principles or concepts are combinable unless obvious contradiction occurs. For example, an application scenario can have some directional sound beams for surround sound effect, multi directional sound beams for multi viewers without interfering each other, some picture related sound beams for displaying object related sound effect, non-directional forward hemisphere sound beam or beams for background or other purposes, in which moving object related soundtrack or soundtracks are embedded to have moving object related sound effect during signal processing of making the same.

Figure 34A:
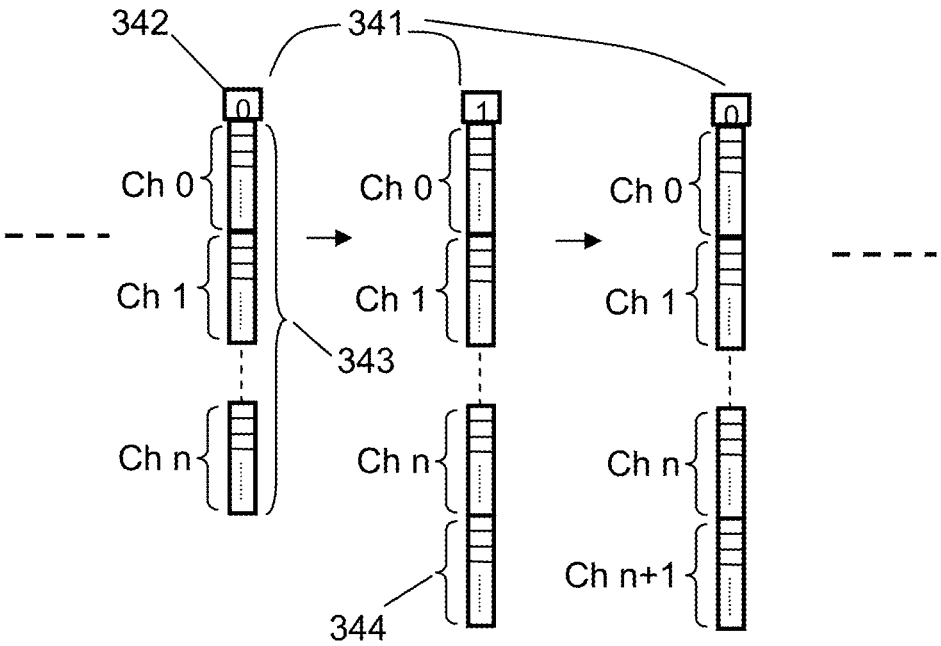
FIGS. 34A and 34B collectively and illustratively show a dynamic encoding scheme of digital audio data stream to handle moving object correlated soundtrack along with fixed soundtracks.
Figure 34B:
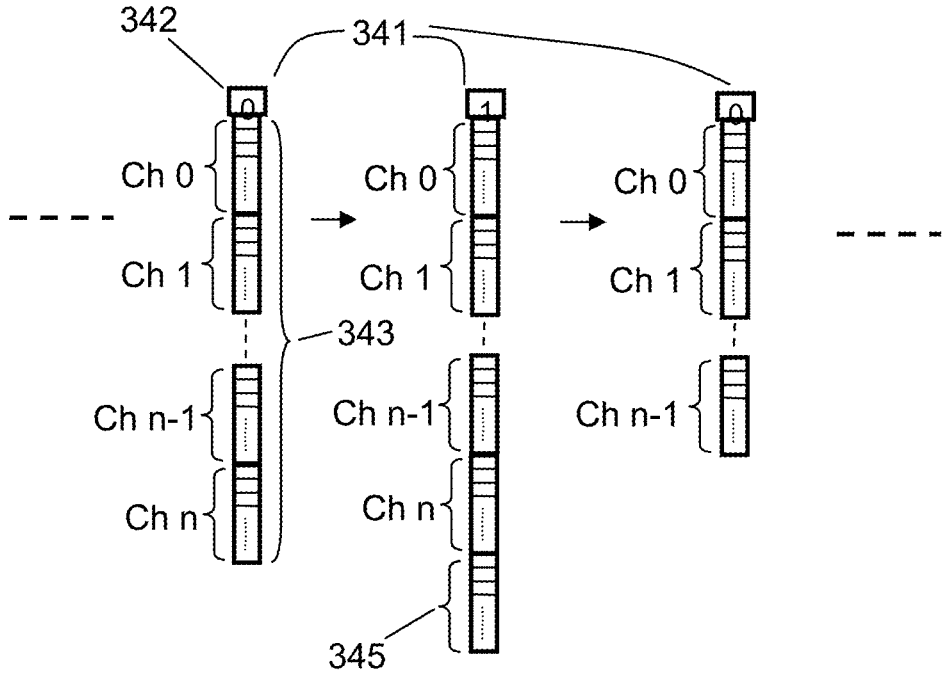

Encoding the soundtrack related moving object requires dynamically presenting the soundtrack signal in audio data. The soundtrack signal exists for approximately the same period as related moving object appears on displaying. FIG. 34 illustratively presents an encoding scheme allowing dynamic existence of a soundtrack data in data stream. As shown in FIG. 34A, the data stream is a series of data frame 341 at time interval determined by sampling frequency. Encoding of a data stream contains data of a variety of soundtracks represented by from Channel 0 to Channel n. Each data frame 341 starts with control header 342, which is illustratively represented by a binary bit 0 or 1, and is followed with a data body 342 containing data of current channels. The control header indicates whether the frame contains command code at end of data body. In the showing of the drawing, bit 0 of header 342 indicates no command code and bit 1 of header 342 indicates command code attached at end of data body 342. The command code comprises action code and data code. The action code has predetermined meaning for intended action to be taken. The data code provides data related to the action. In the drawing, data stream initially contains soundtrack data ranging form channel 0 to channel n. If a new soundtrack represented by channel n+1 is to be presented in the data stream, immediately following data frame has its control header set to "1", indicating command code 344 attached after data body. Command code 344 contains action code of meaning that a new soundtrack data is to be presented starting on next following data frame. Meta information of the new soundtrack data including an identification to itself is provided in data code. Next following data frame has control header set to "0" and data of channel n+1 representing the new soundtrack presents in the data body. Audio data processor or program running on computer should record channel status of the data frame and related information, thus knowing what soundtrack channels are currently presenting in data frame. When a soundtrack reaches its end or expires, its corresponding channel data should be removed from the data stream. FIG. 34B illustratively shows to remove a channel data from the data stream. In the drawing, data frame contains data ranging from channel 0 to channel n. Assuming channel n soundtrack ends or expires, immediately following data frame has control header set to "1". Command code 345 is attached following the data body. Command code 345 has action code with meaning that a soundtrack is to be removed. Then, the identification of the soundtrack, here channel n soundtrack, is provided in data code so that audio processor could know which soundtrack is to be removed. Next following data frame no longer has data of channel n in the data body.

Using above dynamic encoding scheme, audio data stream may have as many channels as needed encoded in order to exploit sounding capability of flat panel displaying and sounding system in accordance with the invention. These channels include fixed channels that correspond to a variety of fixed regions on displaying screen, and dynamic channels that correspond to a variety of dynamically varying regions on displaying screen. Both types of channels may have an everlasting lifetime as long as the data stream does not end, or, have a limited lifetime in the data stream. The channel having limited lifetime has its data only presented within a certain range of data frames of the data stream. A soundtrack not correlating with specific displaying region should be treated as corresponding to whole displaying screen. The encoding scheme also encodes meta information of these channels into data codes of their related command codes. Meta information provides necessary information to define characteristics of soundtrack, such as soundtrack ID, region area defined as polygon coordinates and virtual screen property. Because the data stream is to be used by the systems with a variety of panel sizes, the coordinates of region polygons are based on a virtual screen. The virtual screen property such as screen size or other parameters is provided as well for the system to convert accordingly to fit into the real screen size. Table of FIG. 35 illustratively gives an example of the data stream. In the example. the data stream contains total m soundtracks encoded in as channel number 0 to m. Each channel is encoded to present its corresponding soundtrack identification (ID), type of channel such as "0" for fixed channel and "1" for dynamic channel and regional data correlated with display screen. The regional data contains definition of virtual screen relied upon to define the correlated region, and coordinates of polygon points around periphery of the correlated region. For dynamic channel, command code is used to encode updated regional data when the correlated region moves and changes. Each soundtrack may have different definitions of virtual screens relied upon. Thus it can easily accommodate soundtracks coming from different sources or makers. If a practice standard on the virtual screen for above purpose is established, all soundtracks can be made based on the same definition of virtual screen, thus eliminating necessity of encoding virtual screen definition.

To prevent electromagnetic pollution to environment, complete system embodying the flat panel displaying and sounding system may contain faraday-cup type design either by adding shielding layer into assembly of the flat panel displaying and sounding system or system enclosure, or both.

It is to be understood that, throughout this disclosure, term "layer" means either a layer or a plurality of elements arranged like a layer form. It should be given broadest interpretation according to its conceptual or spiritual meaning.

It should be understood that the invention presented in the disclosure is a broad invention concerning with all disclosed aspects relating to flat panel displaying and sounding system. All patentable rights of these aspects in accordance with the invention are reserved without prejudice.

It should be further understood that embodiments disclosed are only a few examples of possible implementations of the invention and their teachings may be used by ordinary skilled in related art to modify the embodiments or derive from the embodiments to form embodiment appearing not similar as the embodiments but still utilizing true merit and teaching spirit of the invention. Therefore, if any, the modification or derivation is still within the scope of the invention and all related rights are reserved.

I claim:

1. A flat panel system comprising, a flat panel displaying layer having a viewing surface and an opposing surface; and a sounding means comprising a magnetic field layer and an electromagnetic coil array layer having a plurality of electromagnetic coils distributed in array form;

wherein said flat panel displaying layer is sandwiched by said magnetic field layer and said coil array layer with said viewing surface adjacent said coil array layer and said opposing surface adjacent said magnetic field layer;

whereby, during operation, said electromagnetic coils supplied with electric current signals interact with magnetic field generated by said magnetic field layer for said coil array layer making sound.

2. A flat panel system comprising:

a flat panel displaying layer having a viewing surface and a back side surface opposing said viewing surface, wherein said flat panel displaying layer does not have a plurality of holes drilled through its body as sound passages;

a sounding unit array comprising a plurality of sounding units distributed in an array formation, wherein said array formation has a sound emanating side and each of said sounding unit has a sound emanating surface and is oriented to have said sound emanating surface facing substantially toward said sound emanating side;

a first sound impedance matching layer placed in between said sound emanating side of said sounding unit array and said back side surface of said flat panel displaying layer for facilitating transmission of sound from said sounding unit array into said flat panel displaying layer; and a second sound impedance matching layer placed on said viewing surface for facilitating emanation of sound out of said viewing surface, wherein said second impedance matching layer is transparent;

whereby, in operation, sound generated by said sounding unit array pass through said first sound impedance matching layer, said flat panel displaying layer and said second sound impedance matching layer and come out thereof.

3. The flat panel system of claim 2 wherein said flat panel displaying layer embodies a plurality of sound transmission passages to facilitate sound of said sounding unit array to pass through.

4. The flat panel system of claim 3 wherein said sound transmission passages are placed at non-lighting area of said flat panel displaying layer.

5. A flat panel system comprising:

a flat panel displaying layer having a viewing surface;

a sound driver array having a plurality of sound drivers distributed in array form; and a sound generating layer that is transparent;

wherein said flat panel displaying layer is sandwiched by said sound driver array and said sound generating layer with said viewing surface adjacent said sound generating layer, whereby, in operation, lights out of said viewing surface pass through said sound generating layer and said sound generating layer makes sound under driven by said sound driver.

6. The flat panel system of claim 5 further comprising:

a cavity layer having a plurality of surface recesses, wherein, said cavity layer is placed between said flat panel displaying layer and said sound generating layer with said surface recesses adjacent said sound generating layer and aimed laterally to said sound drivers to facilitate said sound generating layer making sound.

7. The flat panel system of claim 5 wherein said sound generating layer contains driver response media made of ferromagnetic material or electromagnetic coils, whereby, in operation, said media responds to magnetic field generated by said sound driver array.

8. The flat panel system of claim 5 wherein said sound generating layer contains driver response media made of ultrasonic wave stopping material, whereby, in operation, said media responds to ultrasonic wave generated by said sound driver array.

9. The flat panel system of claim 5 wherein said sound generating layer contains driver response media made of ions or conductive electrodes, whereby, in operation, said media responds to electrical field generated by said sound driver array.

* * * * *